United States Patent [19]

Bruce et al.

[11] 4,052,249

[45] Oct. 4, 1977

[54] FACE SEALING VALVE APPLICATOR

[75] Inventors: Roger K. Bruce, Mission Viejo; Werner Marhold, Huntington Beach, both of Calif.

[73] Assignee: Sterigard Corporation, Santa Ana, Calif.

[21] Appl. No.: 598,253

[22] Filed: July 23, 1975

[51] Int. Cl.[2] ..... B26D 9/00; B65H 5/08

[52] U.S. Cl. ..... 156/513; 83/255; 83/263; 83/278; 156/521; 156/529; 156/568; 226/58; 226/144; 271/276

[58] Field of Search ..... 156/517, 519, 521, 529, 156/531, 568, 571, 252, 261, 497, 513, DIG. 33, DIG. 35; 226/33, 38, 55, 58, 64, 71, 128, 129, 144, 145, 159; 141/20; 222/394, 195; 83/255, 263, 278; 271/95, 276

[56] References Cited

U.S. PATENT DOCUMENTS

| | | | |
|---|---|---|---|
| 1,995,077 | 3/1935 | Perryman | 156/261 |
| 2,720,994 | 10/1955 | Arvidson | 156/517 |
| 2,779,590 | 1/1957 | Seastrom | 83/278 X |
| 3,367,822 | 2/1968 | Hoffler | 156/571 |
| 3,586,585 | 6/1971 | Kirk et al. | 156/521 |
| 3,607,537 | 9/1971 | Von Hofe et al. | 156/252 |
| 3,753,836 | 8/1973 | Buckholz | 156/521 |
| 3,910,811 | 10/1975 | Paxton et al. | 156/521 |

*Primary Examiner*—Charles E. Van Horn
*Assistant Examiner*—M. G. Wityshyn
*Attorney, Agent, or Firm*—Christie, Parker & Hale

[57] ABSTRACT

A length of face sealing valve stock is formed into individual face sealing valves and applied to end closures of pressurized dispensers. The stock advances in steps by a feed dog in vent slots in the tape. The tape is held against advancement by an index dog at all other times. Lost motion in the feed dog drive accommodates the drive to tape arrest and permits shutdown and startup at a known, predetermined position in a cycle. A head carries a punch and shear blade which form vent slots and cut the tape to valve length during the time that the tape is stopped. Tape is sheared to valve length at an index wheel which holds the tape by vacuum during shear and successive 90° transports for solvent activation of adhesive and transfer from the wheel by bonding the activated adhesive to an end closure. A proximator forces an end closure into contact with a valve during transfer. A manifold moves with respect to the index wheel to brake vacuum at the transfer station, apply an air blast there during valve transfer to an end closure, and to establish vacuum at the shear station just prior to shear. An end closure having a valve falls away from the index wheel and the end closure is stripped from the proximator and conveyed away.

12 Claims, 18 Drawing Figures

FACE SEALING VALVE APPLICATOR

BACKGROUND OF THE INVENTION

The present invention relates to machinery used in the application of gassing valves to end closures and in pressurized dispensers.

Pressurized dispensers, commonly referred to as aerosol dispensers, maintain a product to be dispensed under the pressure of a propellant. The propellant is discharged into the dispenser in an operation called in the art "gassing." One form of gassing is through a valve on an end closure of the dispenser. The valve passes propellant into the dispenser but does not permit propellant to escape.

One type of gassing valve is described in the U.S. Pat. No. 3,880,332 to Merle G. Risdon.

The Risdon valve is a flap valve with a backing of resilient material and a layer of adhesive. The resilient material may be Mylar. The backing and adhesive are coextensive. Only a preselected portion of the adhesive is activated and bonded to the end closure. The balance of the adhesive serves to seal against an inside surface of the end closure and prevents propellant leakage. A vent slot is formed in this valve to prevent excessive spreading of the solvent used in activation of the adhesive.

This specification is directed to an apparatus for applying flap or face sealing valves of the general type disclosed in the Risdon patent to end closures.

SUMMARY OF THE INVENTION

The present invention provides a valve applicator which forms from tape stock a face sealing valve by punching a solvent vent slot into the tape, shearing the tape valve to a predetermined valve length, and activating a limited area of adhesive on the valve for subsequent bonding to an end closure of a pressurized dispenser. The applicator applies the valve to an end closure.

In general, the applicator has feed means for advancing tape stock progressively along a tape path. Means periodically stop tape advance for the formation of a vent slot and the shearing of a valve to length. Means take a valve sheared from the tape and move it for activation of the adhesive, and then move it again for application to an end closure. Means advance the end closures successively for the application of valves.

In a preferred form, the advancing means includes a feed stepping dog which periodically engages a vent slot previously formed in the tape and advances the tape one valve length. The feed dog responds to a drive which forces the dog in a direction to advance tape and permits the arresting of advance after the advance of one length while the feed dog tends to continue the advance. In other words, it is preferred that the feed dog have the facility to overtravel a valve length to assure advance of at least one valve length. The tape is arrested after travel of one valve length by index stop means. The feed advance, however, continues to operate, and the motion of its operation is permitted by a lost motion mechanism means.

The feed drive and lost motion mechanism preferably includes a barrel cam which through a follower ultimately drives a first arm journaled to a shaft. The cam, while the apparatus runs, continuously oscillates the arm. A second arm keyed to the shaft angularly couples to a crank by the latter's keying to the shaft. The crank and first arm couple by a spring. This spring has a spring constant permitting spring flexure at a predetermined load, and thus, relative movement between the first arm on the one hand and the crank, shaft and keyed arm on the other. The feed is driven by the keyed arm as through a rod and lever coupled to a feed dog. The feed dog pivots on an end of the lever and is spring-biased toward the tape path. The spring permits the dog to move towards and away from the tape path so that the dog can ride on the tape to find a vent slot during the initial portion of an advancing step.

Means is preferably provided to initiate lost motion in the feed drive in response to such stimuli as the absence of tape. These means preferably include means to engage the arm keyed to the shaft. To enable initiation of tape feed at a known, predetermined point in the cycle, means is provided to release this arm only at the predetermined point. These means preferably include a bell crank having a first leg with a recessed shoulder and a detent pin in the shoulder which engages the keyed arm only at a predetermined angular position of the arm. A second leg of the bell crank couples to an arm of the crank by receipt in a slot of this crank arm of a pin of the bell crank leg. Only when the pin can clear the slot can the bell crank rotate to detent the keyed arm, and this can only happen at the predetermined point in the cycle. Upon release of the bell crank from the lost motion initiating force the keyed arm can move slightly in response to the spring. When the journaled arm through the spring rotates the crank slightly, the pin will ride into the slot of the keyed crank releasing the bell crank and keyed arm. This occurs only when the keyed arm and the journaled arm are in proper relationship to one another.

The index stop preferably comprises a dog having a head or tooth to engage a vent slot in the tape. This dog very simply is controlled by a reciprocating head. Biasing means, such as a spring, tend to rotate the tooth of the index dog away from a vent slot. This biasing means is overcome by second biasing means which tends to rotate the dog into the slot and has non-yielding positive means to effect slot engagement by the dog.

The head previously referred to, reciprocates up and down towards and away from the tape path and carries a punch. During travel of the head downwardly, a vent slot is punched in the tape. The head also carries a shear blade which during downward motion of the head shears a valve to length.

Shearing preferably takes place on an index wheel at a position conveniently referred to as a shear station. The index wheel cooperates with a shear blade carried by the head to provide a reaction line for the shear blade. Tape is preferably held on the index wheel by vacuum just prior to shearing. The sheared tape advances on the index wheel to a solvent activation station where solvent activates adhesive in a limited area on one side of the tape. After the adhesive has been activated, the index wheel progresses to a transfer station where the valve is bonded to an end closure of a pressurized dispenser. Preferably, the index wheel rotates about 90° between the various stations and has four receivers for receipt of valve lengths. The operations conducted in conjunction with the index wheel occur when that wheel is stopped with respect to the operators. Thus the index wheel at the shear station is stopped when the shear blade cuts the valve to length and is stopped also at the solvent activation station and the station at which the valve is transferred to an end closure.

The valves are light and easily displaced, and for this reason must be positively retained on the index wheel during its travels between the various stations. As previously mentioned, vacuum in the index wheel holds the valve at the shear station from a time just prior to shear. This same vacuum holds the valve until transfer of the valve from the index wheel to an end closure. The vacuum is applied by a manifold which moves angularly with respect to the index wheel to only periodically apply vacuum at the shear station and at the transfer station. The manifold also passes air under pressure to the index wheel at the transfer station during the terminal portions of the application operation to ensure release of the valve by the index wheel to an end closure.

The actual application of the valve to an end closure is preferably by a proximator which takes an end closure from a feed slide and proximates the closure to the index wheel at the transfer station. Here a valve has been prepared for transfer by having a predetermined area of the valve adhesive activated. Pressure applied by the proximator through the end closure on the valve bonds the valve to the end closure and transfers the valve from the index wheel to the end closure. The proximator then leaves the vicinity of the transfer station and the completed end closure is transported away by transport means.

The preferred form of the present invention operates sequentially as follows. The tape on the tape path is advanced by the tape feed dog in step-like fashion one valve length at a time. Advance occurs by engagement of the dog in a vent slot previously formed in the valve. The vent slot is formed first and is formed by the shear punch carried by the reciprocating head. During this punching operation, the index stop engages the vent slot formed in the last cycle. Indexing at this location avoids error accumulation. The feed dog engages a vent slot still further downstream from the punch station and advances the tape an amount determined by the feed index. The vent slot formed by the punch is then engaged by the index stop. This vent and the valve of which it forms a part lie at the shear station on the index wheel. The valve is cut to length by the shear blade of the reciprocating head. Just prior to this shearing, vacuum is applied by the vacuum manifold at the shear station to hold the valve in place during shearing and thereafter. Vacuum is continuously applied as the index wheel advances 90° for solvent activation in a predetermined area of the valve on one side of the vent slot. The index wheel then progresses another 90° to the transfer station where the proximator presents an end closure to the activated adhesive and valve transfer to an end closure takes place.

These and other features, aspects and advantages of the present invention will become more apparent in the following description, appended claims and drawings.

DESCRIPTION OF THE PREFERRED EMBODIMENTS

The Face Sealing Valve and the Apparatus in General

The face sealing valve applicator of the present invention applies face sealing valves to ends of pressurized dispensers. The dispensers contain products under pressure of a propellant for the product's select dispensation. This type of container has come to be known as aerosol container.

Figure 1:
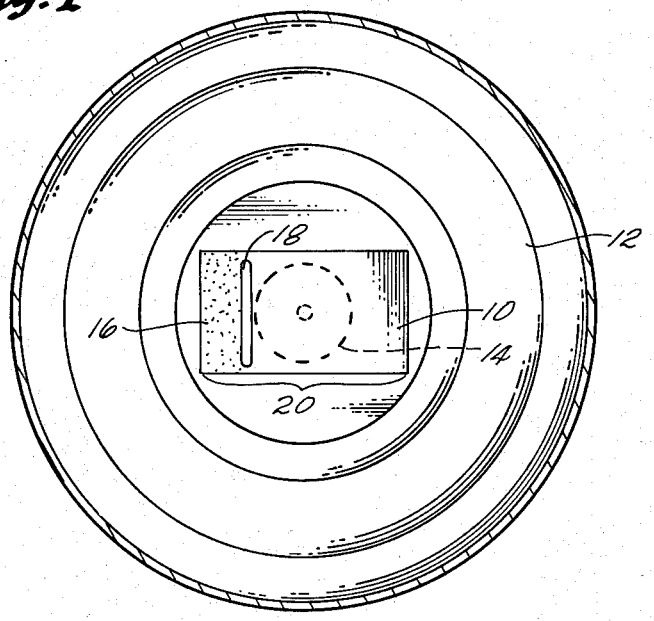
FIG. 1 is a prior art plan veiw of an end closure for a pressurized dispenser, together with a face sealing valve.

The valve is described in detail in U.S. Pat. No. 3,880,332 to Merle G. Risdon. For convenience, the valves and corresponding dispenser ends are shown in FIG. 1. The valve is indicated in general by reference numeral 10. It is affixed to a bottom closure end 12 of a pressurized dispenser. The end is subsequently seamed to a body of the dispenser. The valve is rectangular, flat and thin. It operates like a flap between a closed position and an open position. The open position allows propellant gassing of the pressurized dispenser. Gassing is through an orifice 14 in the bottom closure end. The valve prevents the escape of propellant by sealing on the closure end in response to propellant pressure within the dispenser.

The valve is of two-layer construction. A first layer provides strength and resilience and the second layer provides sealing and attachment to a closure end. The layers are coextensive. The second layer is an adhesive, adhered only in a preselected area to the bottom closure end. This area is shown in FIG. 1 by the stipple and indicated by reference numeral 16. The adhesive bonds the valve to the bottom closure end to keep it in place during propellant charging and thereafter. The adhesive may be solvent activated. In this case, only that portion of the adhesive corresponding to the stippled area of FIG. 1 is activated. The balance of the adhesive outside of the stippled area is not activated and serves to fill interstices between the valve and the adjacent surface of the bottom closure end. The valve has a vent slot 18 to prevent solvent from spreading beyond the stippled area and bonding the valve to the closure end outside of this area. The valve has a length 20. Suitable material for the valve is Mylar.

Figure 2:
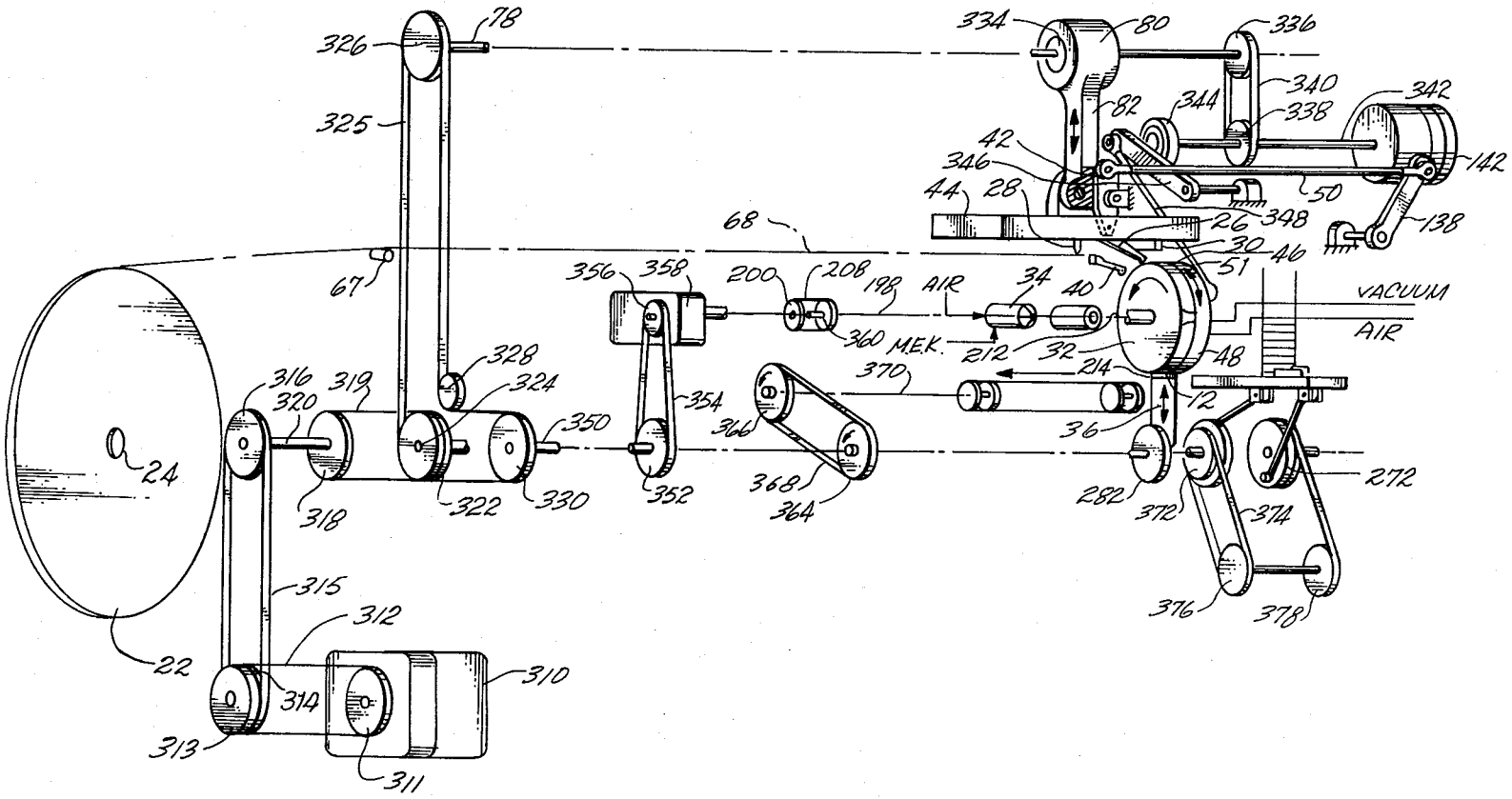
FIG. 2 illustrates in perspective and schematically the synchronous drive of the apparatus of the present invention and operators which form and apply face sealing valves to end closures of a pressurized dispenser.

The function of the apparatus of this invention is to form a valve and apply it to a closure end. FIG. 2 shows schematically how it is done. The valve is formed from a continuous roll of Mylar tape 22 coated on one side with adhesive.

This tape may be regarded as flap-valve stock. The roll of stock is on an unwind mandrel 24. A stepping feed dog 26 advances the tape in step fashion. Between advances the tape is stopped and punched by punch 28 to form the vent slot. Also when the tape is stopped it is sheared to length 20, the length of finished flap valve, by a blade 30. Shearing is downstream from the punch and feed dog. The sheared length of tape, now a valve, is held on an index wheel 32 by vacuum. The index wheel rotates the valve 90° and the adhesive of the valve activated by solvent sprayed onto limited area 16 (FIG. 1) by solvent sprayer 34. The valve then rotates in the same direction on the index wheel 90° to a transfer station for bonding to an end closure. A proximator 36 takes an end closure 12 and presses it against the valve for transfer. The valved end closure is then discharged.

Tape feed dog 26 pushes the tape in step-like fashion one valve length at a time to advance the tape for vent slot formation and shearing to length. An index dog 40 engages the vent slot formed one valve length downstream to determine the amount of feed. The location of the dog one length downstream eliminates error accumulation. Feed dog 26 travels more than a valve length but tape travel is limited to one tape length by dog 40. Dog 40 holding the tape stopped applies a force on the feed dog which initiates lost motion in the feed dog drive. (FIG. 2 omits the lost motion mechanism of the drive). The feed dog oscillates back and forth through a crank 42 of the feed drive. Shear punch 28 is carried on a vertically reciprocating head 44, which also carries shear blade 30.

When a valve is formed it resides at a shear station 46 of index wheel 32. Vacuum applied at the shear station holds the valve before shear but after tape feed onto the shear station. The index wheel rotates 90° to the spray station where adhesive is activated by a solvent. The valve is then rotated to the transfer station where proximator 36 bonds the valve to an end closure 12. During the 180° trip from the shear station to the transfer station, vacuum continuously holds the valve to the index wheel. At the transfer station vacuum terminates and air pressure is applied to insure release of the valve from the index wheel. Vacuum and air are supplied the index wheel through a manifold 48. This manifold is oscillated a few degrees at predetermined times in the cycle to establish vacuum at the shear station, and break vacuum, and initiate air pressure at the transfer station. Oscillation is through an oscillating drive which will be described but which is shown at 51.

The Tape Reel, Punch and Shear Blade

Figure 3:
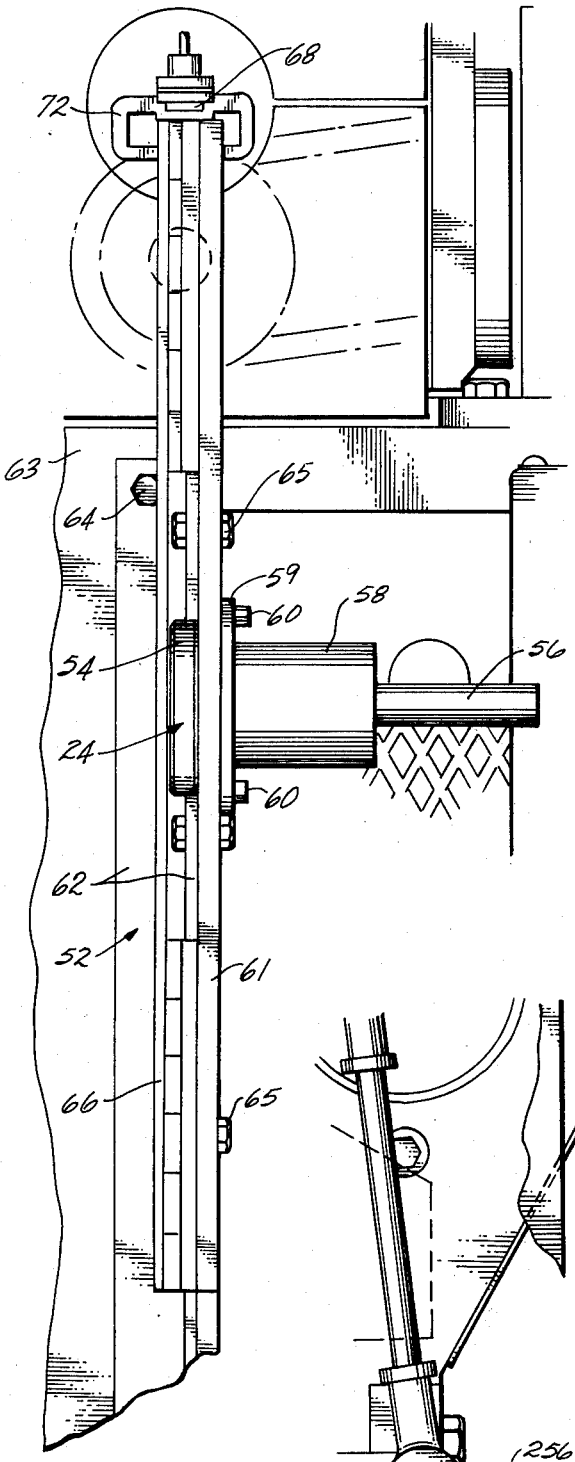
FIG. 3 is an end elevation of a tape feed mandrel and tape path.

FIG. 3 shows the tape reel end on at reference character 52. The reel has mandrel 24 formed of a hub 54, a shaft 56 attached to the hub, and a bearing 58 receiving the shaft. The hub and shaft rotate about their common axis as tape feeds. The bearing mounts to the frame of the apparatus through a flange 59 fastened by fasteners 60 to a side plate and guard 61. An angle 62 attached to an end plate 63 of the frame as by bolts 64 mounts side plate 61 as through nut and bolt fasteners 65. A detachable cover 66 is carried by side plate 61. As seen in FIG. 2, coiled tape stock mounts on unwind mandrel 24 so that it feeds from the top of the coil over an idler 67 (FIG. 2) and into a tape path 68 (FIG. 2).

The feed of the tape is the responsibility of tape feed and index mechanism 70 which is shown integrated in the apparatus in FIGS. 4*a* and 4*b* and in detail in FIGS. 5 through 9 and which will be discussed subsequently.

Initially, however, reference is to FIGS. 2 and 3. The tape on path 68 travels in a channel 72 which prevents horizontal excursions of the tape from the path. This channel is shown in end view in FIG. 3.

Figure 4A:
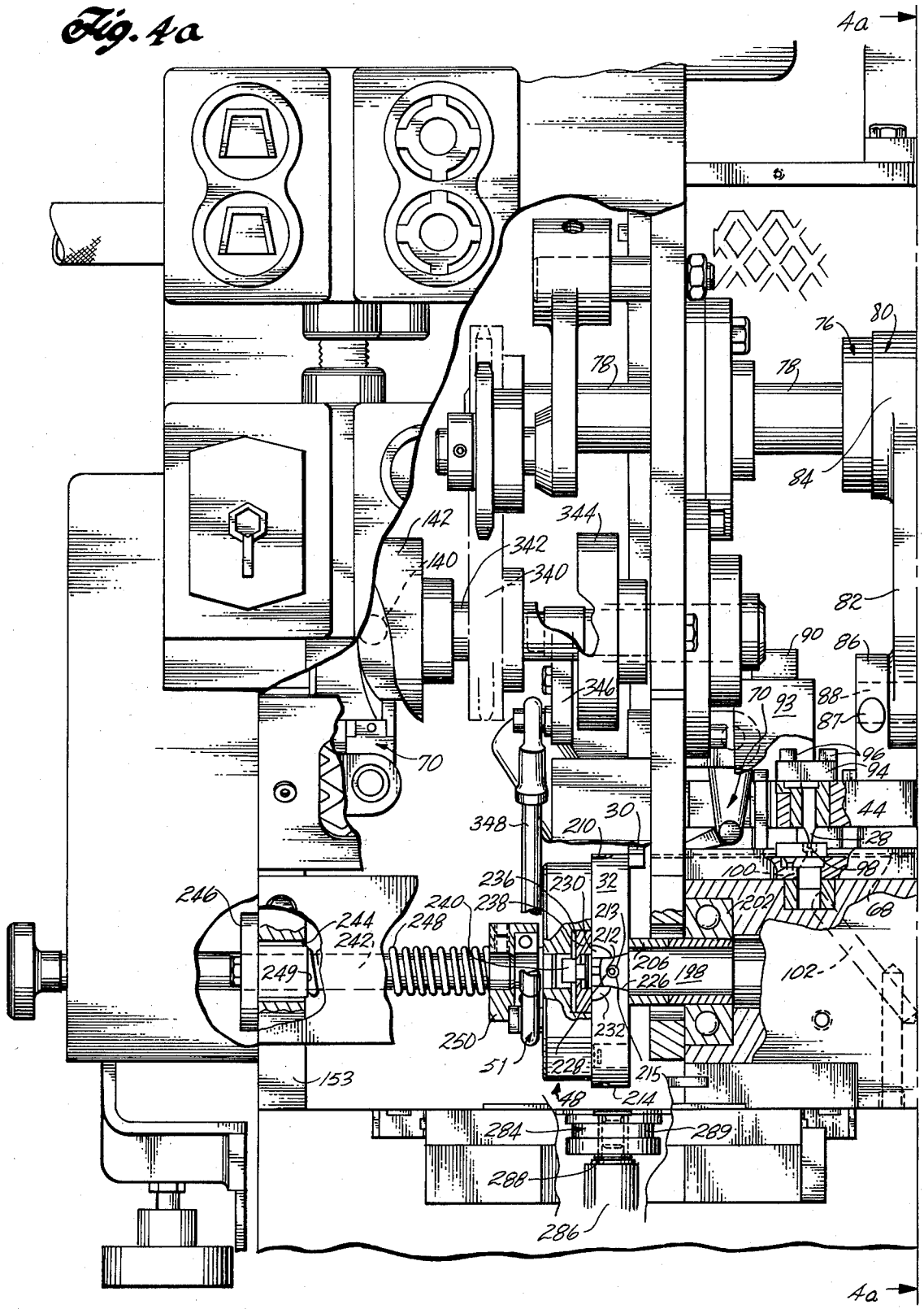
FIGS. 4*a* and 4*b* depict, in elevation and in places partially broken away, the heart of the apparatus; the Figures are separated into FIGS. 4*a* and 4*b* to present them in sufficient size for understanding; registration of the Figures along the section lines 4*a* and 4*b* complete the rendering.
Figure 4B:
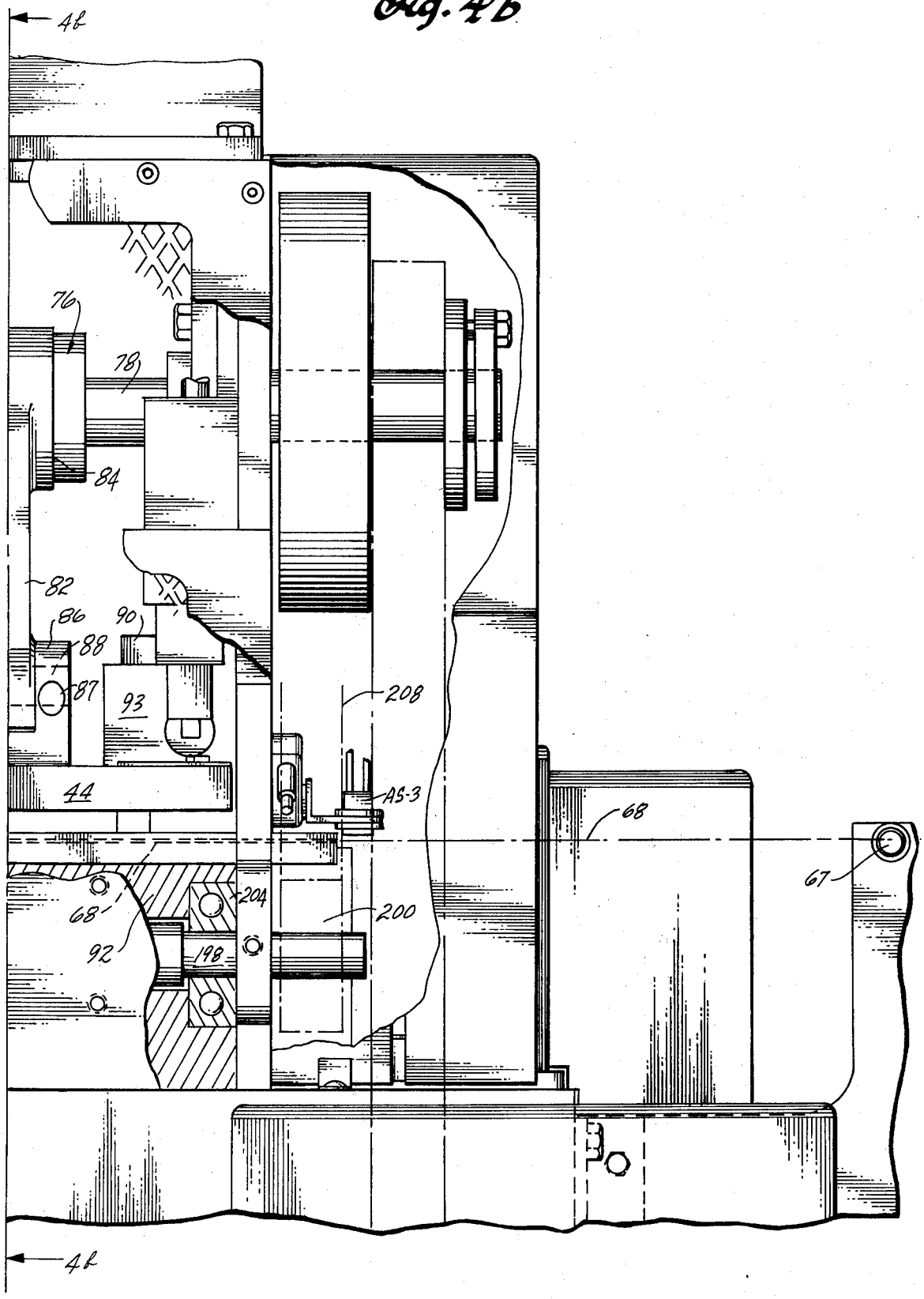

As seen in FIG. 4*a,* head 44 above the tape path carries punch 28, which forms solvent vent 18 in the finished valve. The action of the punch is the first forming operation on the tape. Head 44 is mounted for vertical movement towards and away from the tape path, up and down in the Figure. This motion is accomplished through a head drive 76 off of a cross shaft 78. An eccentric keyed to this shaft drives a follower 80 up and down. This follower includes an arm 82 and a journal 84. Clevis 86 receives the journal and is attached to and forms a part of head 44. Attachment may be by male threaded fasteners in holes 87 in the clevis received in threads of the head. The clevis and journal of the follower are pivotally coupled by a pin 88.

Vertical shafts 90 extending upwardly from their attachment to a bed 92 are received in linear bearings 93 attached to the head. The shafts and bearings prevent (a) the head from moving horizontally (in the plane of the tape path), and (b) canting of the head from the horizontal, and (c) yawing of the head about the vertical.

Punch 28 mounts on the head as through a block 94 and fasteners 96. The punch has a nose 98 which does the actual punch forming of the venting slot of the valve. A die 100 provides reaction shear edges for the punch. A vacuum manifold line 102 to a source of vacuum opens into the die to draw away from the punching zone material sheared from the tape.

The punch then operates reciprocally, up and down, into the path of the tape to cooperate with the die and periodically punch the vent slots of the finished flap-type valve. Punching occurs when the tape is stopped.

These punched vent slots serve in the tape feed and index mechanism.

Figure 7:
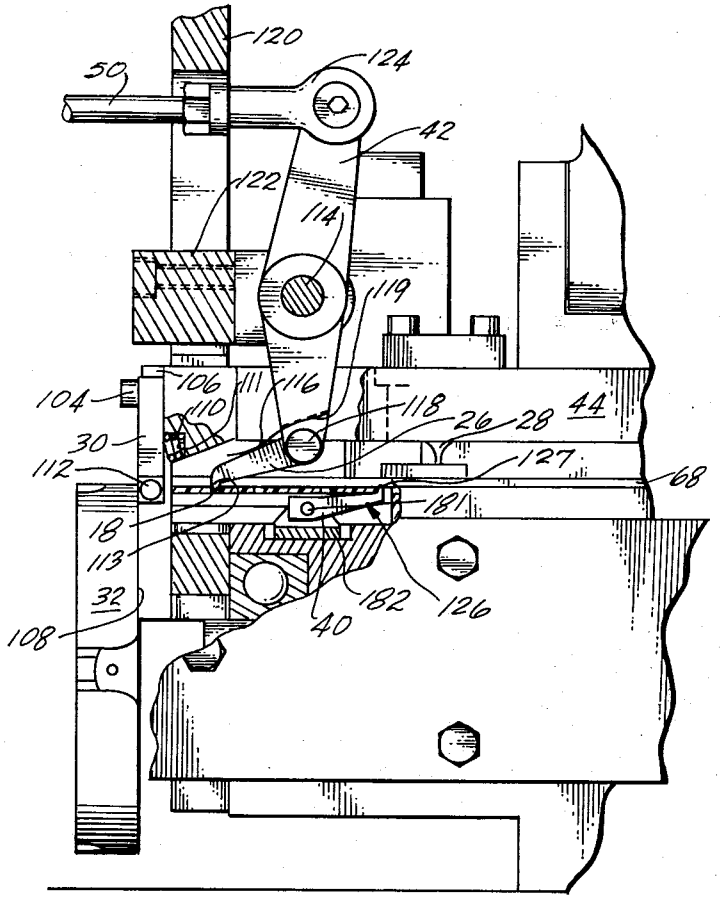
FIG. 7 is an elevational, partly fragmented, view of the index wheel, the head which carries the shear blade and punch, a portion of the tape feed advance, and a portion of the index stop.

As seen in FIG. 7, shear blade 30 is carried by head 44 through a shoulder bolt 104. The walls of slot 106 in the head prevents pendulous movement of the shear blade across the tape path. The attachment of the blade by bolt 104 allow limited movement of the blade into adjacent end face 108 of index wheel 32. A compression spring 110 confined in a hole 111 where the head forces the blade into engagement with the adjacent face of the index wheel. Guides 112 in the bed keep the tape on the path right up to the index wheel.

Shearing occurs when the tape is stopped and at the same time that punching occurs.

Tape Feed and Index

The tape feed and index mechanism show in detail in FIGS. 5 through 9 the tape advances in step-like fashion in response to feed dog 26 an amount limited by indexing dog 40. Each advance of the tape moves it a distance equal to the length of the finished valve. The stepping dog overtravels to insure that the index dog alone determines the amount of tape advance. Also from time to time tape feed stops as when the coil of tape stock is exhausted. Before feed is reestablished, the feed dog must be synchronized with other mechanisms which work on the tape, for example, the shear blade which shears the valves to length.

With reference to FIG. 7 dog 26 has a nose or tooth 113 which engages the tape in the slots formed by punch 28 and pushes on the tape to advance the tape to the left in the picture. The dog is pivoted on crank or lever 42 which is pivoted at 114. The lever is oscillated by a drive, which includes rod 50. The drive retracts the dog tooth from the slot after each step advance of the tape. In the Figure, dog 26 is shown with its nose or tooth in a slot 18 of the tape. A leaf spring 116 biases the dog into this position but permits the dog to pivot about the axis of a pin 118 at the end of lever 42. One end of the leaf spring bears on an upper surface of the dog in the direction of the tape path and away from pivot 114. The other end of the spring bears on a bridge of a clevis of lever 42. This clevis mounts pin 118. As lever 42 rotates counter clockwise in FIG. 7, index dog 40 engages the tape. Tooth 113 of dog 26 will then be forced from the tape with dog 26 rotating clockwise in the Figure. The fulcrum of lever 42 at pin 114 is mounted to a bulkhead 120 of the frame through a clevis block 122. Rod 50 joins lever 42 through a rod end 124 which permits relative angular motion between the lever and the rod.

An index assembly 126 includes dog 40 which has a tooth 127 that indexes the tape to proper advance distance, the length of the finished valve. Dog 40 engages a slot 18 of the tape during the last part of the stepping feed dog's stroke in a tape advancing direction and the return of the stepping dog from its most advanced position to its start position. Importantly, dog 40 prevents too much tape advance on account of drive dog 26 by engaging a vent slot even while dog 26 tends to continue tape advance. The index dog releases when the drive dog engages the tape for advancing the tape. Details of the index dog will be described subsequently.

Figure 5:
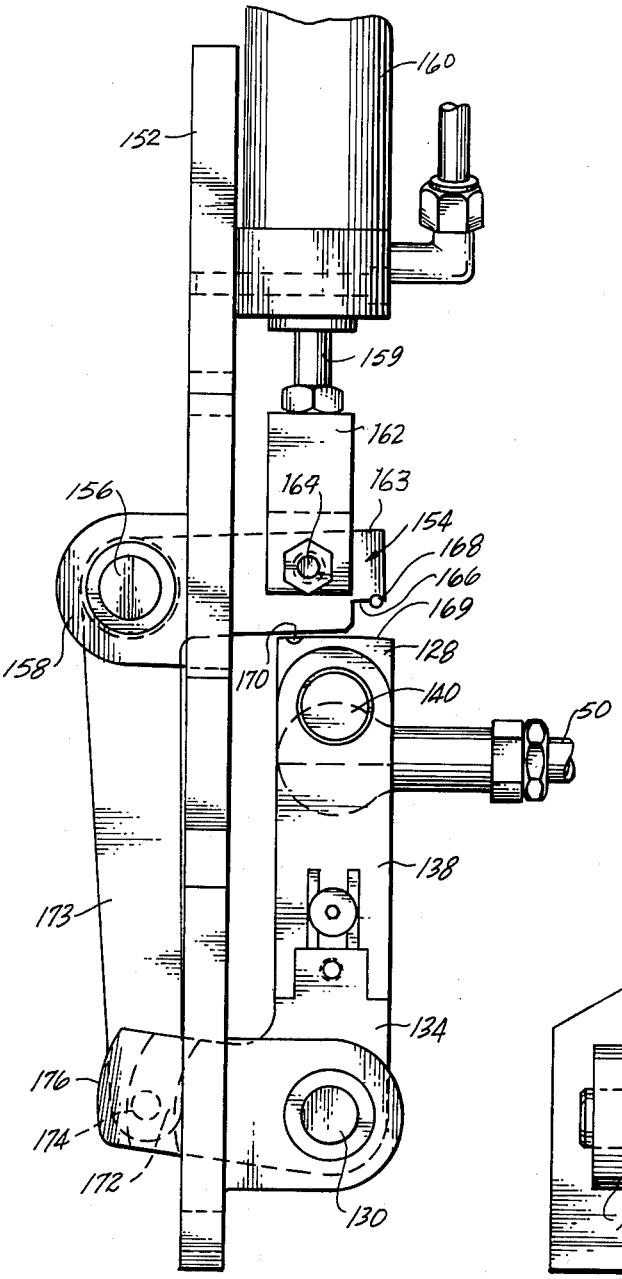
FIG. 5 is a side elevational view of the lost motion initiation and accommodation mechanism of the tape feed.
Figure 6:
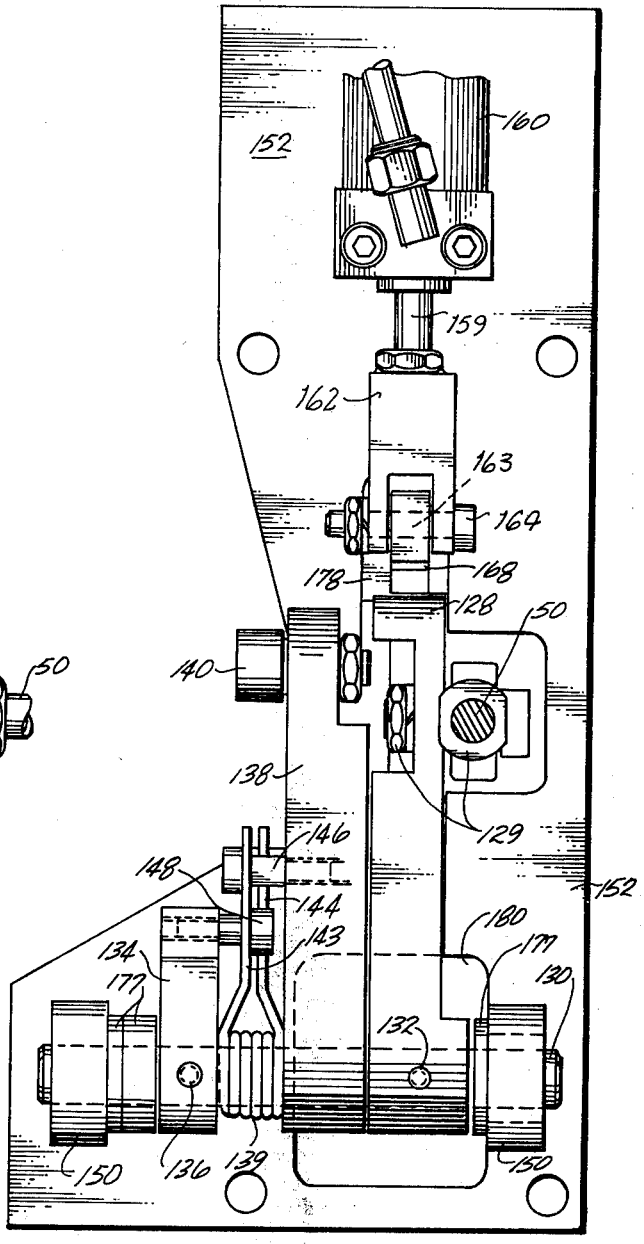
FIG. 6 is a front elevation of the lost motion initiation and accommodation mechanism of FIG. 5.

Returning to the tape feed or advance mechanism and with specific reference to FIGS. 5 and 6, rod 50 is pivotally connected to a lever arm 128 as through a rod end eye and fastener 129. Thus, rod 50 has its ends pivotally connected to dog drive lever 42 and to arm 128.

Arm 128 responds to a drive which permits the stopping of tape advance through lost motion without total machine shutdown in response to tape engagement by the index dog and predetermined circumstances.

Arm 128 is fastened to a cross shaft 130 as through a set screw 132. A crank 134 connects to cross shaft 130 as through a set screw 136. A drive arm 138 is journaled on cross shaft 130 for relative angular movement and couples to crank 134, and arm 128 by this arm and shaft 130, through a torque spring 139.

Arm 138 is the drive arm of the assembly shown in FIGS. 5 and 6, but it is driven by a cam drive. Arm 138 mounts a follower 140 which tracks in the slot of a barrel cam 142 shown in FIG. 4*a.* Torque spring 139 coils about cross shaft 130 and has upstanding legs 143 and 144. These legs straddle and bear on a shoulder of a shoulder bolt 146, which screws into arm 138, and a shoulder of a similar shoulder bolt 148, which screws into crank 134. Thus, motion of arm 138 transmits to crank 134, cross shaft 130, and arm 128 through the shoulder bolt 146, the arms of torque spring 139 and shoulder bolt 148. When the resistance provided by crank 134 to rotation is high, arm 138 will oscillate in response to the drive by the cam. This motion will merely rotationally flex the legs of the torque spring. This coupling permits the continuous drive of arm 138 without advancing tape.

Cross shaft 130 is journaled in bearings in bosses 150 which are in turn anchored to a plate 152. Plate 152 in turn is anchored to an end plate 153, shown in FIG. 4, as by conventional fasteners.

The tape feed is disabled in response to the engagement of the tape by the index dog or predetermined conditions in the apparatus for example, when there are no closure ends or when the tape on the reel is gone. With the predetermined condition it is desirable to shut down the tape drive and to do so in a manner that will assure that the tape drive will be at a predetermined position in a cycle.

As will become apparent, all function drives are in synchronization because the drives are positively interconnected.

These ends are met for the tape advance as follows. A bell crank 154 is pivotally mounted on a pin 156. The pin is secured in bosses 158. These bosses are attached to plate 152. The short arm of this bell crank is pivotally coupled to an output shaft 159 of a pneumatic cylinder 160. Specifically, output shaft 159 of cylinder 160 carries a clevis 162 which receives short arm 163 of the bell crank and is pivotally attached to the arm as through a shoulder bolt 164. Arm 163 is stepped at its end and proximate arm 128, the step being indicated at 166. The step defines a shoulder in which a detent pin 168 resides. A facing end 169 of arm 128 is slotted at 170 to receive pin 168. Crank 134 has a slot 172 extending circumferentially about the arm's axis of rotation, the axis of cross shaft 130. A long arm 173 of the bell crank has a pin 174 normally received in the slot. Crank 134 in normal operation oscillates in response to the input from cam 142 going through arm 138 and spring 139. In this normal operation slot 172 oscillates with respect to pin 174. However, when it is time for feed shutdown (in distinction to just the lost motion which occurs before and after step advance of the tape), the motion of the arm 128 and crank 134 must be stopped. When a shutdown signal is transmitted to pneumatic cylinder 160, it will try to extend shaft 159 and rotate short arm 163 of crank 154 clockwise in FIG. 5. This will tend to force pin 168 into slot 170 of arm 138. Clearly this will not occur until shoulder 166 overrides the end of arm 128. This in turn cannot occur until crank 134 rotates clockwise in FIG. 5 and is freed from pin 174. Upon rotation of bell crank 154, pin 174 will move clockwise about pin 156 away from slot 172 and the axis of rotation of crank 134, the axis of shaft 130. The pin will then be proximate an outer arcuate surface 176 of crank 134. Pin 168 can now find slot 170 to couple the pneumatic cylinder and arm 128 together. Now the motion of arm 138 is taken up in torque spring 139 and there is no following motion of crank 134 or arm 128.

When the pneumatic cylinder releases, there will be a tendency for bell crank 154 to rotate counterclockwise. This cannot occur unless crank 134 is in proper position for pin 174 to travel along the bottom surface between surface 176 and slot 172 into the slot. This position is present when spring 139 moves crank 134 slightly clockwise and this happens only when the journaled, constantly oscillating arm and crank 134 are in proper time. Since the position of crank 134 in the most clockwise position corresponds to a pedetermined position of the tape and that position corresponds to a point in the timing cycle of the whole apparatus, the tape advance is always in the same position during shutdown by pneumatic cylinder 160.

The lost motion to accommodate the tendency of the feed dog to advance further than the one valve length and just before actual tape advance works in a similar manner. Instead of the restraining force of pneumatic pressure through cylinder 160, index dog 40 arrests tape advance. This applies a force through rod 50 which overcomes the tendency of arm 128 to oscillate. Arm 128 is stopped in this case by rod 50 instead of pin 168. An incidental to this drive includes the making of slot 172 of crank 134 sufficiently wide to accommodate crank motion without bearing on pin 174 and tending to rotate bell crank 154. Spacers 177 index the arms, spring and cranks on shaft 130 in proper location with respect to each other. Cutouts 178 and 180 of plate 152 pass arm 163 of crank 154 and crank 134.

Figure 8:
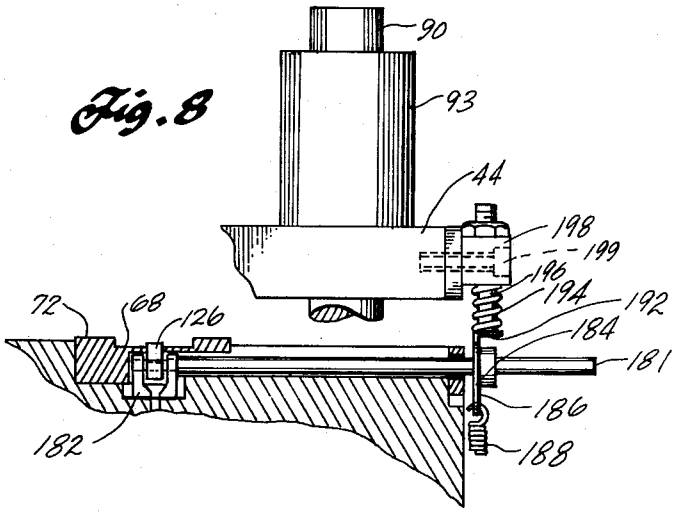
FIG. 8 is an end elevation, partly in section, partly fragmented, of the bed of the apparatus in which the index stop resides; the mechanism for disengaging and engaging the index stop from a slot in the tape and the head which controls such engagement and disengagement.
Figure 9:
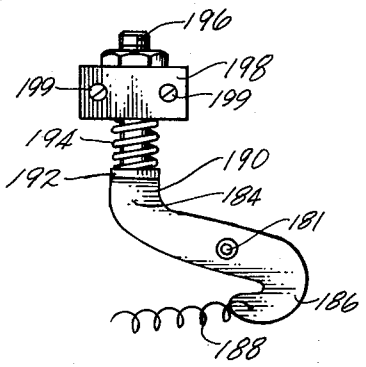
FIG. 9 is an end elevational view of the control for the index stop.

Index stop dog 40, which keeps the tape indexed in the tape path with respect to the operators on the tape, and the dog's attendants are shown in FIGS. 7, 8 and 9. As described, index dog 40 has a tooth 127 which engages a vent slot 18 in the tape one valve length after punch 28. This position for the indexing by the dog minimizes error in tape length, as determined ultimately by shearing at the index wheel.

Dog 40 is pivoted on a pin 181 of a mount 182 secured on the bed of the apparatus below the tape path. Pivot pin 181 for the dog extends laterally from channel 72 (and tape path 68) for coupling to vertically reciprocating head 44. A crank 184, secured to the pin, has an ear 186 which receives one end of a return spring 188. The other end of the return spring anchors to the stationary bed of the apparatus. The return spring tends to force dog 40 into engagement in the punched slot of the tape. The crank also has an ear 190 from which a pad 192 laterally extends. A compression spring 194 bears against this pad as does push rod 196. The compression spring and rod are mounted to the head as through a block 198 attached to the head by fasteners 199. Spring 194 tends to rotate the dog out of engagement with the tape. Thus, at a point during the time when the head moves up in its stroke, return spring 188 commands the dog and rotates pin 181 in the direction to push tooth 127 of dog 40 into the punched vent slot (bite the tape). At a point during the time when the head moves downwardly in its stroke, spring 194 and rod 196 command the dog to rotate the tooth of the dog out of the slot (release the tape). Spring 194 alone is often not enough to fully force pin 181 and dog 40 to rotate and it is the responsibility of rod 196 to positively force the dog out of the valve slot.

Thus when head 44 moves downwardly, punch 28 punches out a venting slot in the tape, blade 30 shears a length of tape and dog 40 keeps the tape stopped and properly indexed while this is going on. As mentioned, indexing is in the slot immediately downstream of the punch station after punching and shearing. The tape is advanced by drive dog 26 which is engaged in still another slot by pushing the tape to the left in FIG. 7. During tape advance the index dog is released. Release happens during the last part of downward travel of the head and continues during the first part of head travel upward because the pivot pin upon which index dog 40 is mounted is under the dictate of rod 196 and spring 194. During the balance of head travel, pin 181 is under the order of return spring 188 and tape engagement is possible. At a time during the end of the tape advance stroke the index dog can engage the tape, and the slot in the tape just formed by punching will find tooth 127. Also, before tape advance but while the feed dog moves in an advancing direction, the index dog holds the tape until after the feed dog picks up the tape.

Index Wheel, Manifold and Activator

Index wheel 32 and manifold 48 will be described with primary emphasis on FIGS. **4*a*, 4*b*, 10 and 11. Index wheel 32 mounts on a shaft 198 which extends through the bed below the tape path to a drive gear 200. The shaft is received in bearings 202 and 204. A bushing 206 on the shaft axially locates the index wheel. The index wheel is driven by a chain 208 from a gear box which advances the index wheel in 90° steps so that four 90° spaced apart tape receivers successively stop at an uppermost position of the index wheel adjacent shear blade 30. The receiver at this shear station is shown at reference numeral 210. At this station, a receiver first accepts the end of the tape roll. The length of received tape is the length of a finished valve. The end is then held at this receiver and sheared to valve length by the shear blade. There are two other stations associated with the index wheel: a solvent activation or spray station shown at 212, and a transfer station shown at 214.** These latter two stations are also at positions where the index wheel stops. Each station for one complete revolution of the index wheel sees each of the index wheel's four receivers.

Figure 11:
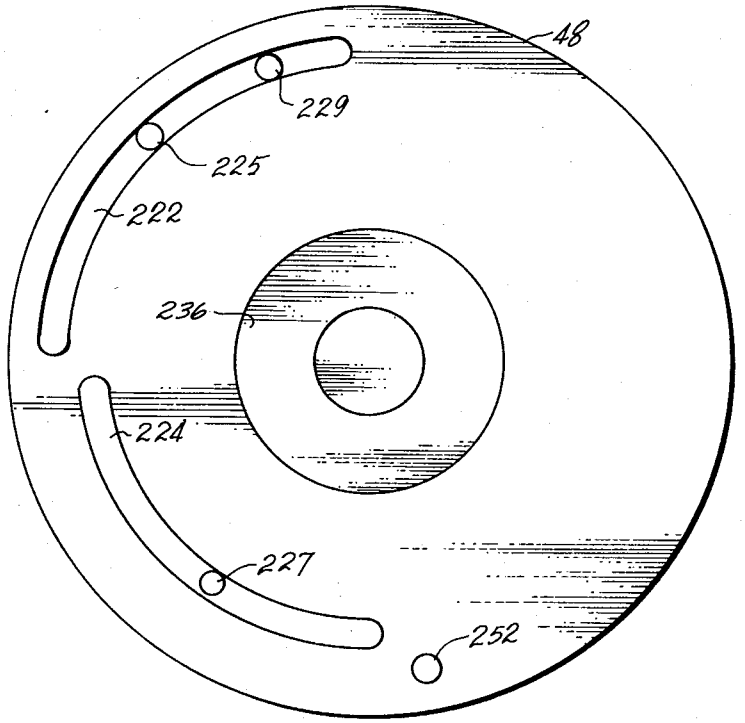
FIG. 11 is a plan of the manifold which cooperates with the index wheel.

The wheel has a port 213 to each of its receivers for the application of tape holding vacuum to the tape and for the application of air under pressure to release the tape at a different time. The port, in the plane of the wheel, extends from a recess 215 (FIG. **4*a*) towards the wheel axis. Two axially directed ports 216 and 218 open into the radial port and a radial face 220 of the wheel. There are identical pairs of these ports for each of the four receivers. Axial port 216 selectively communicates with a circumferentially extending, constant radius slot 222 of manifold 48 (FIG. 11). Axially extending port 218 selectively communicates with a second circumferentially extending, constant radius slot 224** of the manifold.

Circumferential slots 222 and 224 of the manifold provide vacuum to the four receivers to hold valves in place. The slots together extend substantially 180°. Vacuum to the slots is from a source and flexible lines through ports 225 and 227 opening, respectively, into slots 222 and 224. A port 229 in slot 222 is to a vacuum switch.

The provision of two slots spanning 180° but not in vacuum communication with one another allows the sensing of the absence of a valve at the shear station and to use this signal to terminate end closure feed when no valves will be available to be applied to an end closure. The loss of a valve at the shear station usually indicates something which requires attention, for example, the exhaustion of the tape supply. The occasional loss of tape at another station is normally anomalous and not worth operator attention. If the slots spanning the half circle between the shear station and the transfer station were in communication, then the loss of vacuum at locations other than the shear station would cause end feed shutdown. Additionally, as will become apparent, end feed shutdown still will feed one end to the transfer station. Thus, even with valve loss at the shear station, the next preceding valve has had its adhesive activated at the activation station and an end will be available for receipt of a valve. Stated in different terms, the loss of vacuum as when tape is not fed onto the index wheel at the shear station, stops the advance of ends except for one. The valve at the activation station will be matched with this one end.

Figure 10:
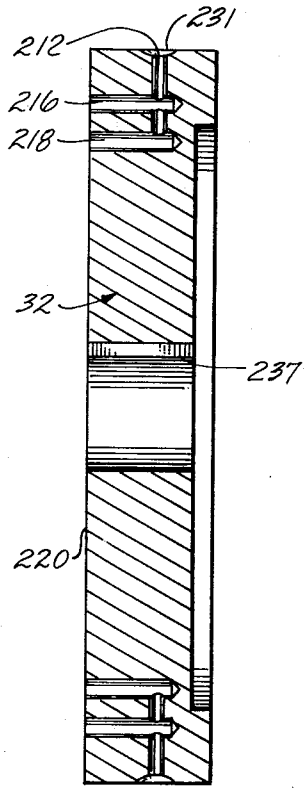
FIG. 10 is an elevation, half-section of the index wheel.

Receiver configuration is illustrated to best effect in FIG. 4*a*. In that Figure, the station has a diverging mouth 226 and a flat 228. The mouth is adjacent the plane of the shear blade and axially with respect to the index wheel axis of rotation, spaces the flat from this plane. This mouth is inclined slightly with respect to the axis of the index wheel to open slightly in the direction of the shear blade. This slight cant assures receipt of a valve even if the valve dips slightly toward the axis of the wheel. The flat is parallel to the axis of the wheel. The flat applies the greatest contact pressure on the valve during transfer of the valve to an end at the transfer station. The receiver port opens into the receiver medially as seen in FIG. 10 through recess 215. The recess, or counter bore provide a large area on the valve for suction. The wheel is relieved at 230 and 232 to either circumferential side of each receiver to avoid contact with a circumferential bead of the end closure. A keyway 237 receives a key to hold the wheel to shaft 198.

Index wheel 32 and manifold 48 are in lap sealing engagement at the end of the wheel axially opposite the shear blade. The manifold is recessed at 236 to accommodate a centering and bearing washer 238 for the manifold. A cap screw 240 and centering washer 238 secure wheel 32 to shaft 198.

Manifold 48 mounts for oscillation on a shaft 242 which is coaxial with the index wheel. Shaft 242 is mounted in a bushing 244 in the bed as through a washer and bolt 246. A compression spring 248 received on the shaft bears against a shoulder 249 of the shaft and, through a bearing, and thrust washer 250 bears on the bearing mount manifold. This spring urges the manifold against the index wheel.

The manifold is oscillated a few degrees through an oscillator drive 51. Oscillation establishes vacuum at the shear station after tape feed onto the index wheel and prior to shear. In addition, oscillation breaks the valve holding vacuum at the transfer station at the time the valve is transferred to an end. Vacuum is established at the receiver at the shear station by oscillating the manifold so that axial passage 216 to the port 213 in the index wheel is in register with the circumferential slot 222 of the manifold during shear and the first part of index wheel rotation. When the manifold is not oscillated, there is no vacuum at the shear station.

At tape transfer, to assure complete transfer, an air blast is applied to the valve from the index wheel and onto the end closure piece. This air pressure is admitted through a port 252 in the manifold which registers with outermost radial passage 216 of the index wheel at transfer. This occurs also during oscillation of the manifold. During air blast, the receiver at the transfer station does not experience vacuum.

Figure 12:
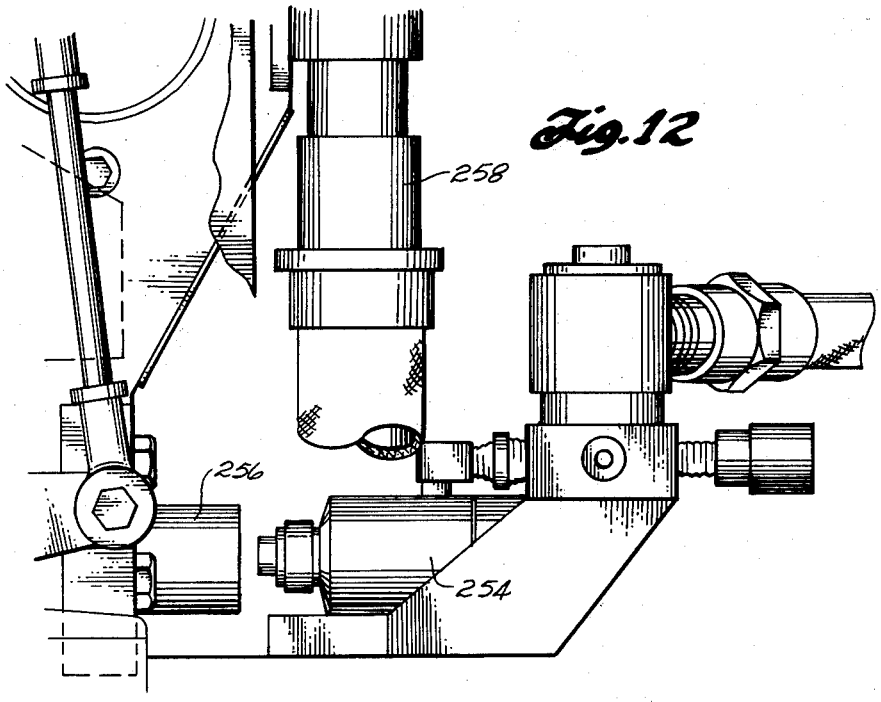
FIG. 12 is an elevation showing the solvent activator.

FIG. 12 illustrates the activator used to activate adhesive at the activation or spray station. The adhesive of the valve is solvent activatable, for example, by methyl ethyl ketone. The activator is merely a gun 254 which takes methyl ethyl ketone from a source and sprays it through a columnating cylinder 256, which has a window sized to pass solvent to the area of the valve to be activated and no more. The cylinder and gun are mounted to the bed of the apparatus to direct a solvent spray perpendicular to the receiver of the index wheel at activator station. After activation, the index wheel progresses 90° down to the transfer station. A blower may be used to evacuate solvent fumes as through a line 258.

End Closure Feed and Discharge

Figure 13:
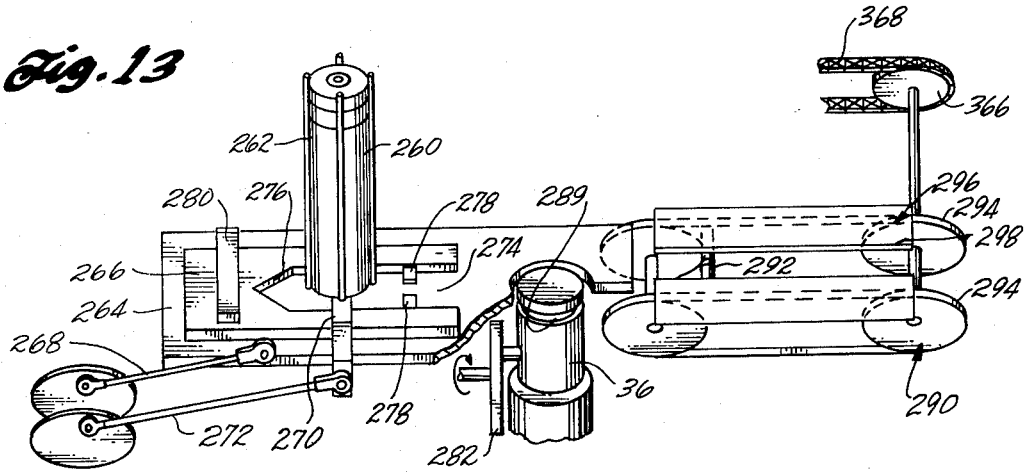
FIG. 13 is a schematic perspective of the end closure feed, proximator, and take-away transport.

With reference to FIGS. 2 and 13, valves having a predetermined area of their adhesive layer activated by solvent at activation station 212 are rotated 90° by index wheel 32 to transfer station 214. Here an end closure piece is proximated to the valve and the valve transferred to the piece by the proximation and an air blast through the index wheel. The end closure is then completed and goes to accumulation.

Generally the apparatus for end closure feed to the zone where proximation occurs, proximation, and transport to accumulation is known for another application, end lining. Therefore, the description of this apparatus will be brief.

A stack of end closure pieces 260 in a receiver or magazine 262 lies above a table 264 and a ram or slide 266 for feeding end closures to the slide. Slide 266 reciprocates back and forth beneath the magazine in response to a crank drive 268. Separator knives 270 reciprocate back and forth beneath the end closures in the magazine in response to a crank drive 272. These knives keep the end closures in the magazine except for a periodic release of one closure for feed, valve application, and accumulation.

Slide 266 has a slot 274 along the line of slide reciprocation. This slot is based by a "V" 276, which pushes end closures onto proximator 36 for application to a valve. Opposed stripper lugs 278 extend into slot 274 and push end closures with valves attached away from the zone of proximation and into an accumulator feed.

A stop 280 sends individual enclosure ends riding on a surface of the slide into V-shaped slot 274.

As previously related, proximator 36 goes up and down in response to a cam drive, shown in FIGS. 2 and 13 at 282, to proximate end closures to valves and to have the valves applied to the end closures. With reference again to FIG. 4*a*, proximator 36 has a chuck 284 mounted serially to a pedestal 286 through a Belleville spring 288. As the pedestal rises and the end it carries contacts the index wheel, a force will be applied on the end to the Belleville spring and the magnitude of the force is controlled by the spring constant of the Belleville spring. An annular groove 289 in the chuck passes stripper lugs 278 during the backstroke of the slide and while the chuck is elevated.

An endless transport conveyor 290 in the form of a chain drive receives finished end closures and transports them away from the proximation zone for accumulation. The transport has pop-up lugs 292 carried by endless chains 294 which engage the rear of an end closure and transports that enclosure along the path of chain for travel. Guides 296 overlie the path of enclosures on the conveyor and a pair of rails 298 support the end closures in their travel.

The events take place in this sequence. When the slide or ram is forward in close association with proximator 36, knives 270 clear the stack of end closures in magazine 262 and the stack drops onto the slide to the rear of the V-shaped slot. The slide then goes back and the knives reenter the stack to maintain the stack from feeding further ends. The end on the surface of the slide greets stop 280 near the end of slide backward travel and is forced into the V-shaped slot. When the slide goes forward again the V-shaped slot pushes the end and moves it over proximator 36.

Proximator 36 then proximates the end closure to the valve on the index wheel and the valve transfers to the end closure. After transfer, proximator 36 lowers to a position for stripper lugs 278 travelling forward to strip the completed closure end and feed it to transport 290 where lugs 292 pick up the end and carry it to accumulation.

Stripper lugs 278 pick up the completed end closure during the forward stroke of the slide while proximator 36 is down and go past the proximator. When the proximator is up, the stripper lugs return during the backstroke of the slide through groove 289.

The Drive

FIG. 2 illustrates the drive for the various components of the apparatus described. This drive is shown very schematically. The prime mover is a motor 310 which, through a sprocket 311 drives an endless chain 312 which drives a sprocket 313. This sprocket is coupled to a sprocket 314 of another endless chain drive 315. A sprocket 316 of the latter chain drive is coupled to a sprocket 318 of another chain drive 319 through an axle 320. Sprocket 318 drives a sprocket 322 through endless chain 319. A sprocket 324 is driven by sprocket 322. Sprocket 324 drives a chain 325. This chain drives a crown sprocket 326 engaged by an idler 328, which maintains the wrap of the chain on sprocket 326 and a third sprocket 330, also driven by the chain. Crown sprocket 326 drives a shaft 332 which drives an eccentric 334 for follower 80 and rod 82. As will be recalled rod 82 drives head 44 up and down, as indicated by the double headed arrow in the schematic. Shaft 332 continues past eccentric 334 to a sprocket 336, which drives a driven sprocket 338 through an endless chain 340. Driven sprocket 338 keys to a shaft 342 which drives barrel cam 142 and a cam wheel 344. Barrel cam 142 reciprocates arm 138 of index drive 70 through a follower in the manner described. But, briefly, drive 70 reciprocates feed or stepping dog 26 for the advance of tape along tape path 68 through rod 50 and an arm 42. The lost motion compensation is not shown in FIG. 2 for simplification. Wheel cam 344 drives arm 346 through a follower attached to that arm and that arm in turn drives a rod 348 of oscillator drive 51 for the oscillation of manifold 48.

Sprocket 330 drives a shaft 350 which drives a sprocket 352. Sprocket 352 drives a chain 354 which drives a sprocket 356. Sprocket 356 drives a stepping or intermittent gear box 358. Gear box 358 drives index wheel 32 through an endless chain drive which includes chain 208, sprocket 200 and shaft 198 previously referred to in FIGS. 4*a* and 4*b*, and a take-off sprocket 360 from the gear box. Gear box 358 drives the index wheel with a Geneva-like motion, namely, the index wheel advances 90° and stops for a period and advances another 90° and stops, and so on.

Shaft 350 from sprocket 330 also drives a sprocket 364 which drives a sprocket 366 through an endless chain 368. Sprocket 366 through a shaft 370 drives endless conveyor 290.

Shaft 350 also drives cam 282 which reciprocates proximator 36 up and down.

Shaft 350 also drives a sprocket 372 which through a chain 374 and a sprocket doublet 376 and 378 drives a crank 272 for reciprocating knives 270. Shaft 350 also drives crank 268 for reciprocating ram or slide 266.

The sequence of each of the functions of the apparatus with respect to one another is controlled by the drive. The drive accomplishes requisite sequencing in a manner which will become clear in the timing section of this specification.

Control Circuits

The following describes control circuits for the flap valve applicator of the present invention.

Figure 14:
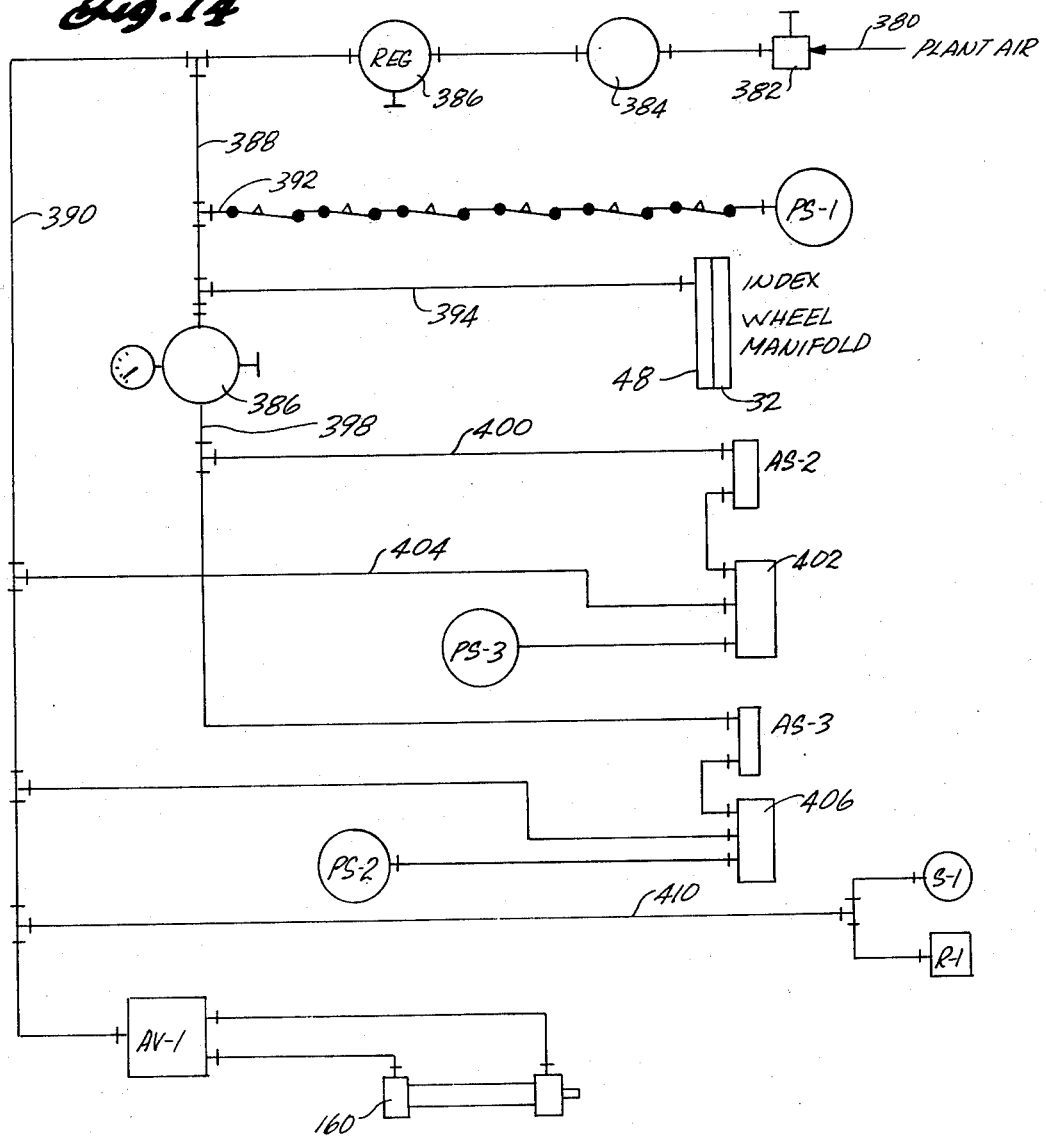
FIG. 14 is a line schematic of the pneumatic-fluidic control circuit of the apparatus.

FIG. 14 schematically depicts a pneumatic-fluidic circuit for the applicator. Plant air through a line 380 is controlled by an on-off valve 382 in the line. A filter 384 is in the line serially upstream from a first stage regulator 386. Line 380 branches into parallel lines 388 and 390. A branch line 392 tees off of line 388 and has serially connected pneumatic switches LV-1, LV-2, LV-3, LV-4, LV-5 and LV-6. These pneumatic switches are in series upstream of pressure switch PS-1. Switches LV-1 through LV-6 are normally closed. Any one of these switches when opened, opens normally closed pressure switch PS-1, and as will be seen, shuts down the entire apparatus or will not permit the apparatus to be started in the first place. Pneumatic switches LV-1, LV-3, LV-4, LV-5, and LV-6 sense whether guards to protect operating personnel are in place for: a hand wheel, the tape feed, the vent punch, the shear blade, and the index wheel, respectively. Pneumatic switch LV-2 senses a jam on the completed end closure transport conveyor.

Teeing off line 388, line 394 leads to manifold-index wheel complex 48–32 for the air blast accompanying valve transfer from the index wheel to an end closure at the transfer station for each of the four valve receivers of the index wheel.

A low stage regulator 396 in line 388 feeds a low pressure line 398. Line 398 tees into a line 400. Line 400 has an air sensor switch AS-2 which for its part is in series with a pressure booster 402. Pressure booster 402 receives high pressure air from line 404 which tees into line 390. A pressure switch PS-3 indicates a low level of ends in magazine 262. Pressure switch PS-3 is normally open and will be closed if air switch AS-2 senses the low level of ends.

Low pressure line 398 also contans an air switch AS-3, which is in series with a pressure booster 406. A line 408 from high pressure air line 390 feeds pressure booster 406. Pressure switch PS-2 is supplied by booster 406. This switch indicates no tape on the tape path. Pressure sensitive switch PS-2 is normally open and closes when air switch AS-3 sees no tape on the tape path.

High pressure line 390 feeds the solvent activator spray solenoid S-1 and a parallel air relay R-1 through a line 410. When air stops, air relay R-1 closes the solenoid S-1. High pressure line 390 also feeds an air valve AV-1 which in turn controls air cylinder 160. AV-1 is air valve controlled by vacuum and electrically in a manner to be described.

The location of pneumatic-fluidic control devices air switch AS-2 and cylinder 160 on the apparatus are shown in FIGS. 4*a*, 4*b*, 5 and 6.

Figure 15:
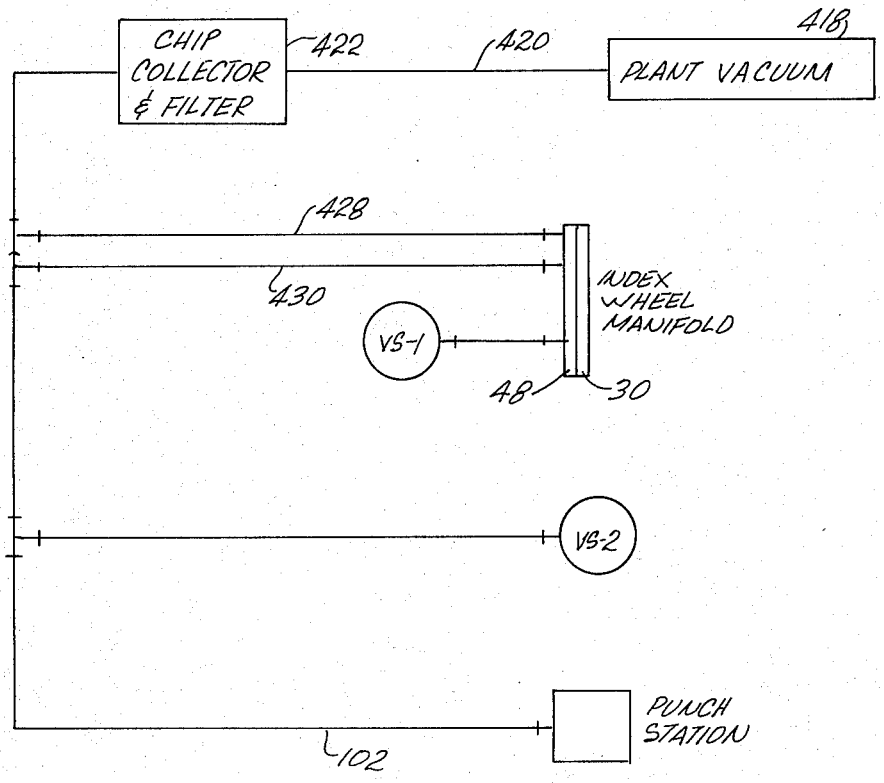
FIG. 15 is a line schematic of the vacuum circuit of the apparatus.

FIG. 15 shows the vacuum circuit for the applicator. Vacuum from plant vacuum 418 supplies a line 420 which is in series with a chip collector and filter 422, which in turn is in series with a punch station 424 through line 102, (the punch station being at punch 28 and die 100). A vacuum switch VS-2 is in series with plant vacuum through lines 426 and 420. A vacuum switch VS-1 for the index wheel manifold complex 32–48 is in series communication with plant vacuum through parallel lines 428 and 430. Vacuum switch VS-1 has normally open and normally closed contacts to control air valve AV-1 and a control relay CR-1 of the solvent applicator gun.

Figure 16:
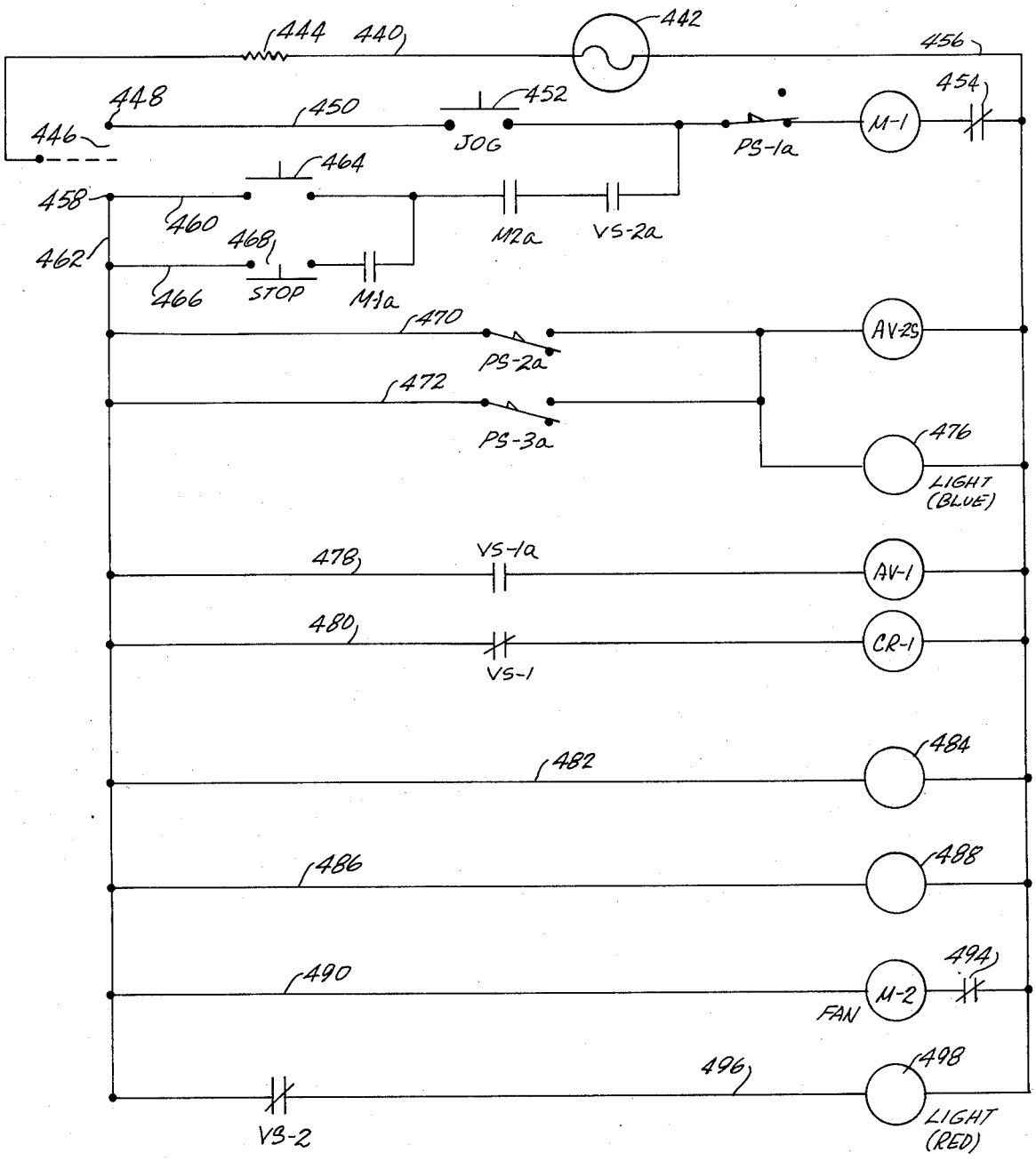
FIG. 16 is a line schematic of the electrical circuit of the apparatus.

Referencing now FIG. 16, the electrical circuit of the applicator is shown. A hot line 440 from a source of power 442 is in series with the balance of the electrical circuit through a fuse 444. The line is wired to a three-way switch 446. A manual terminal 448 of the switch is in series through a line 450 to a normally open jog switch 452, which in turn is in series with normally closed pressure switch contacts PS-1*a*. As previously mentioned, pressure switch PS-1 controls main drive motor 310 and this is done through pressure switch contacts PS-1*a*, and a motor relay M-1 having the usual normally closed overload contacts 454. The contacts are wired to ground 456. Thus, when manual operation is desired to jog the machine for whatever purpose, three-way switch 446 is switched to manual and jog switch 452 is closed.

Three-way switch 446 has an automatic operation terminal 458 which is in series with parallel lines 460 and 462. Line 460 is in series with normally open start switch 464, which in turn is in series with normally open exhaust fan contacts M-2*a*. Exhaust fan contacts M-2*a* sense whether the exhaust fan from the solvent spray unit is on, and if it is on, contacts M-2*a* will close. Line 460 is also in series with vacuum switch contacts VS-2*a*. These contacts are normally open and close only upon sensing the requisite amount of plant vacuum. The contacts are of vacuum switch VS-2. Line 460 is in series with motor drive relay M-1 through pressure switch contacts PS-1*a*. Thus, both the exhaust fan and plant vacuum must be on before the main drive motor will energize; also the various personnel guards must be in place, and there can be no end closure jam on the transport conveyor so that pressure switch PS-1 remains closed.

Line 466 from line 462 goes through a normally closed stop switch 468 and normally open holding contacts M-1*a*. The branch of line 466 parallels start switch 464. When the start switch closes the circuit through the switch to the drive motor control relay, holding contacts M-1*a* will close to maintain the circuit to motor 310 when start switch 464 opens. To stop motor drive 310, stop switch 468 must be opened, and this will drop the motor control relay out of circuit and will also open holding contacts M-1*a*.

Next are two parallel branch circuits 470 and 472 to an air valve solenoid AV-2*s* for an air valve and an indicator light 476. This air valve when activated initiates lost motion in the end closure feed. Two parallel switching elements of the branches to air valve solenoid AV-2*s* determine when the solenoid is energized. These two switching elements are pressure switch contacts PS-2*a*, indicating no tape, and pressure switch contacts PS-3*a*, indicating low container ends in the magazine. These contacts are of pressure switches PS-2 and PS-3*a*, respectively. If any of the switching elements close, air valve solenoid AV-2*s* is energized to terminate end feed. Light 476 will also go on to indicate end feed termination.

The next parallel branch 478 includes normally open vacuum switch contacts VS-1*a* in series with the solenoid of air valve AV-1. Normally open vacuum switch contacts VS-1*a* sense the vacuum in the index wheel-manifold combination. If the absolute pressure builds up beyond a predetermined maximum, vacuum switch VS-1 will close contacts VS-1*a* and energize the solenoid of air valve AV-1. This activates air cylinder 160. Air cylinder 160 initiates the lost motion on the tape feed to prevent the advance of the tape.

The next parallel branch 480 includes normally closed vacuum switch contacts VS-1*b* of vacuum switch VS-1 and control relay CR-1. When vacuum is lost, contacts VS-1*b* open to open the circuit to control relay CR-1. When control relay CR-1 drops out of circuit, the spray solenoid associated with the solvent activator is chopped out of circuit to stop the spraying of solvent.

The next parallel circuit 482 is through a timer 484 for the spray solenoid. This timer is adjustable and determines the time that solvent is being sprayed during a cycle.

The next parallel circuit 486 is to a light 488 to indicate that the power is on.

The next parallel circuit 490 is to the fan motor starter relay M-2 for the exhaust associated with solvent application. This starter relay is in series with the normally provided overload contacts 494.

The next parallel circuit 496 has normally closed contacts VS-2*b* of vacuum switch VS-2. These contacts close when there is insufficient vacuum in the vacuum circuit and establish a circuit to light an indicator light 498.

Timing

Figure 17:
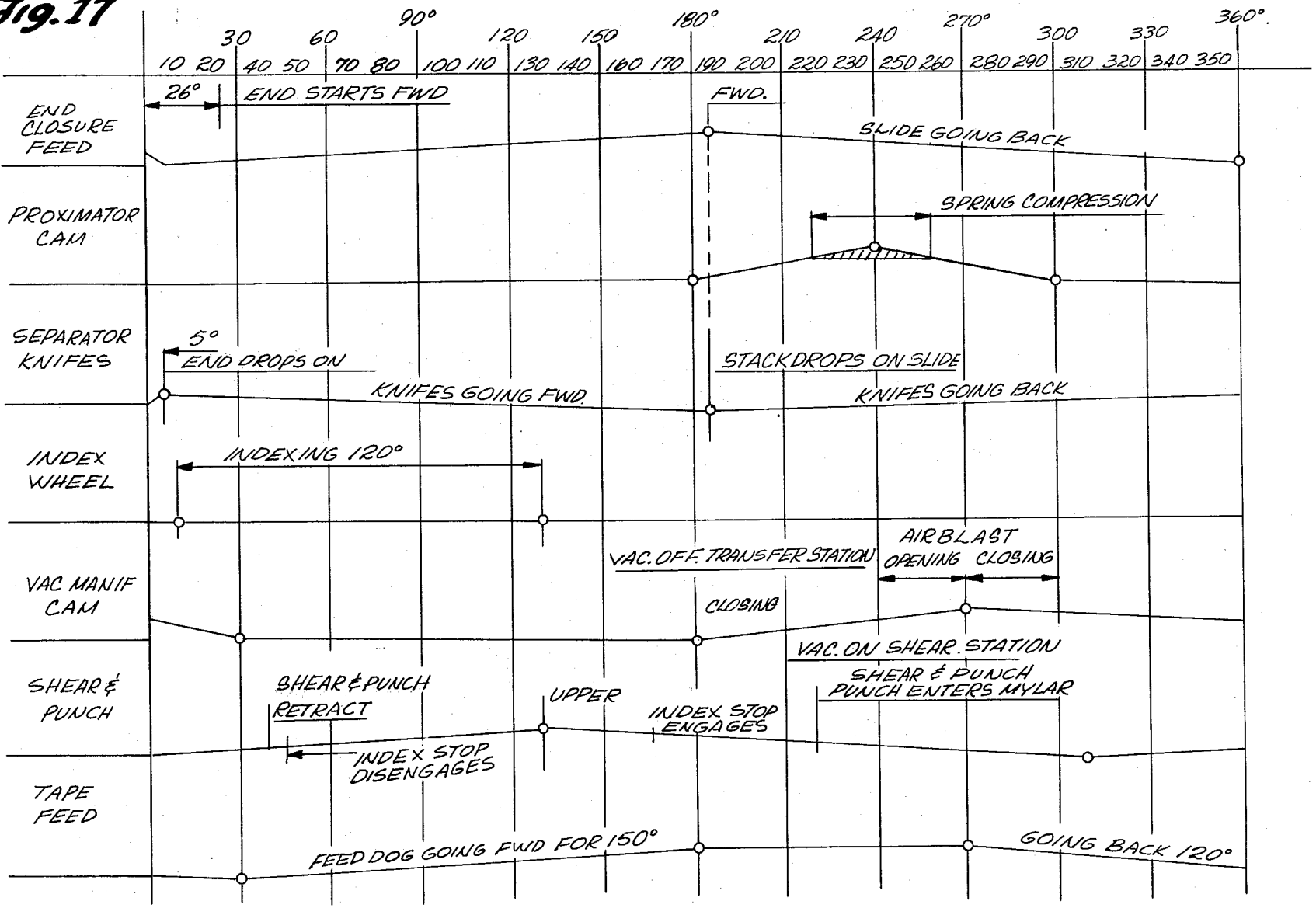
FIG. 17 is a timing chart to illustrate the sequence of operation of the various operators of the apparatus.

With reference to FIG. 17, the sequence of operation of the applicator will be described. The Figure shows a timing chart which uses as a base an arbitrary 360° cycle. The individual operations depicted over the 360° cycle are with respect to each other.

As the chart shows, the ram or slide of the end discharge advances to a forward dead center position at about 185° and then returns. The forward position corresponds to a position of the slide toward the proximator. The separator knives are timed to drop the end closures in the magazine on the ram just as the ram begins its back stroke and then re-engages the end closures in the magazine to prevent further feed of closures onto the backward travelling slide. The slide carries an end closure back until it encounters the stop and the end's motion is arrested. The slide continues back a few degrees. At about 5° on the cycle, corresponding to the ram reaching the end of its backward stroke, the end drops on the table in the path of the slide in the V-shaped slot. About 20° travel of the slide forward is then necessary to pick up the end for its transport to the proximator and application chuck.

The proximator begins to rise to proximate an end closure to the index wheel at about 180°. Contact between an end closure and a valve held on the index wheel occurs between about 220° and about 260° and within this portion of the cycle, the Belleville spring will compress. The lift of the proximator begins reducing at about 240° and the proximator is completely retracted at about 300°.

The stripper lugs clear a completed end closure from the proximator prior to proximate lift and during the forward stroke of the slide. The lugs return past the proximator during the time of proximate lift by passing through the groove in the proximator chuck.

Commencing at about 10° and continuing to about 130°, a total duration of about 120°, the index wheel advances 90°. It will be recalled that the index wheel is controlled by a Geneva-like drive, and therefore, the fact that it rotates but 90° during 120° of the cycle on the timing chart should not cause confusion.

Vacuum manifold oscillator 51 begins its oscillation at 180° and completes oscillation at about 30°. At about 210° manifold 48 has oscillated enough to apply vacuum at the shear station. Vacuum is continuously applied at the activation station whether the vacuum manifold oscillates or not. At the valve transfer station, the vacuum is cut off at about the time vacuum is applied at the shear station, that is, at about 210° in the cycle. The vacuum applied at the shear station continues to be applied from about 210° to about 30°. At the transfer station, an air blast is applied between 240° to about 300° in the cycle. Beginning at about the time that vacuum is terminated at the transfer station and continuing through the air blast, an end closure presses against a valve at the transfer station. Transfer can take place by virtue of this force. The air blast assures complete release of the valve from index wheel 32. After transfer, vacuum continues off for several degrees.

As the index wheel advances 90°, a valve progresses from the shear station to the activation station; a second valve progresses from the activation station to the transfer station; and as will be apparent, tape is fed onto the index wheel at the shear station. As tape feeds to a receiver at the shear station, no vacuum is applied to this receiver. Vacuum begins at this receiver because of manifold oscillation and is continuous because of the index wheel's own movement with respect to the manifold. During index wheel advance, it rotates with respect to the vacuum manifold. During the first few degrees of such rotation, the vacuum manifold is still being displaced by the oscillator drive, and because of the displacement vacuum exists at the shear station. With sufficient rotational movement of the index wheel with respect to the vacuum manifold, vacuum will be applied at the receiver leaving the shear station to hold a cut valve on the index wheel, notwithstanding the end of manifold oscillation. Vacuum is applied to this receiver through two cycles. From just before shearing of tape to valve length at a receiver, vacuum continuously exists at this receiver through two index wheel advances.

Shear blade 30 and punch 28 reciprocate up and down on head 44. As the head rises, the shear and punch move away from the tape path. As the head lowers, the shear and punch move in the direction of the tape path. The head moves away from the shear path beginning at about 310° or so of the cycle and continuing to 130° or so in the cycle. The head lowers during the balance of the cycle. At about 40° in the cycle, the shear and punch retract from the tape. Just after this event, index stop 40 disengages from the tape to free it for advance by feed dog 26. The shear and punch reenter the tape at about 220° in the cycle after the tape has been advanced one valve length.

The tape feed stepping dog drive moves forward in a direction to advance tape from about 30° to about 180° in the cycle. The index stop engages the tape in a vent slot during the first few degrees of feed dog travel forward. This gives time for the feed dog to find a slot and to get into complete engagement with the tape. When the index stop disengages, at about 45°, the tape is free to go forward by the action of the feed dog. The tape continues forward until about 170° where the index stop reengages the tape. Although the tape stops at this point, the feed dog drive continues in the forward direction. As related previously, the forward impetus of the feed dog when the tape is stopped is taken up by the lost motion mechanism, and this occurs at the beginning and the end of the forward cycle of the tape feed dog.

The timing chart does not show the sequence of the solvent activator. Solvent activation can take place at the activation station any time that the index wheel is not indexing. In the timing chart this leaves from about 135° to about 15° for solvent activation. In fact, only a few degrees of the cycle are required for activation of solvent.

The end conveyor transport for end closures having applied valves is also not shown in the timing chart. The conveyor continuously operates, and picks up completed end closures at or near the forward most point of slide travel, this occurring at about 185°.

Operation

The operation of the apparatus of the present invention is believed to have been adequately described previously. However, the operation will be recapitulated here with emphasis on the formation of a single flap valve and the application of that valve to an end closure. This discussion will have primary reference to FIGS. 2 and 17.

A coil of tape on unwind mandrel 24 is played over idler 67 and into channel 72 (FIG. 3). It may be necessary to attach to this tape a leader having one punched vent slot for indexing the tape with the index dog and feed dog.

The tape in channel 72 is held by index stop 40 when punch 28 enters the tape at about 220° in the cycle. The tape remains stationary through the balance of the cycle until about 70° in the next cycle. At about 40° the punch leaves the tape. During this time head 44 moves towards the valve for the period of about 130° to about 310°, and then it moves away from the valve until about 130°.

At about 70° the index stop disengages from the slot of the valve formed in the next preceding cycle, and feed dog 26 will push the tape one valve length along tape path 68. The time for this advance is from about 70° to about 165° in the cycle. Just prior to index stop disengagement the feed dog will move with respect to the tape to find a vent slot. The vent slot found for tape advance is a number of valve lengths downstream from the valve under emphasis here.

Lost motion in the feed dog advance permitted by the operation of torsion spring 139 keeps the feed dog and tape from moving until the tape release by the index dog.

To complete this tape advance, the index dog finds the advancing vent slot of the valve under scrutiny. The tape feed, however, will continue to try to advance the tape feed dog in a forward direction, and again, lost motion prevents this.

As is evident from FIG. 7, the tape moves several steps forward before the valve under scrutiny reaches the shear station. The valve reaches the shear station by feed dog advance of tape onto one of the four receivers of the index wheel. This advance is 70° during the period to about 165°. At first arrival, the valve at the shear station is integrated with the tape for awhile. The tape stops. Vacuum manifold oscillator drive 51 will oscillate vacuum manifold 48 to register port 216 with slot 222 (FIGS. 10 and 11) and establish vacuum at the particular receiver at the shear station. The valve will then be held to the index wheel. Then the shear blade enters the tape to shear the valve from the tape, entry being at about 220°. Vacuum at the receiver at the shear station continues by virtue of the displacement of the manifold by oscillator drive 51.

The indexing wheel advances 90° in the time 10° to 130° of a cycle. This movement of the index wheel with respect to the manifold continues the application of vacuum to the receiver to hold the valve. The valve will arrive at the tape activation station where the adhesive of the valve will be activated by solvent. Vacuum still holds the valve on the receiver.

The index wheel will index another 90° to the transfer station. After the valve arrives at the transfer station, the vacuum still is present at the receiver, and, therefore, the valve and index wheel are still together. The vacuum is present there because the manifold is not oscillating during this portion of the cycle, about 130° to about 180°, and slot 224 of manifold 48 registers with axial port 218 of the index wheel. At 180° the vacuum manifold begins to oscillate, and the index wheel is stationary. At 210° oscillation has progressed sufficiently to break the vaccum at the transfer station. However, at this time the proximator 36 has elevated an enclosure end into contact with the valve. The valve will thereupon transfer to the enclosure, the transfer being assured by an air blast applied through the receiver to the valve by registration of port 252 with axial port 216. Transfer having been completed, the proximator will pull away from the index wheel and arrive at its remote position with respect to the index wheel at about 300°. At this time, slide 266 will be going away from the proximator. The slide eventually moves toward the proximator, and stripper lugs 278 engage the completed end and push it off the proximator and onto discharge conveyor 290, where the completed end will go to accumulation and eventual incorporation into a pressurized dispenser.

It is believed that important features of the present invention relating to malfunction and explicit operation of the stepping feed dog drive and index dog drive were presented in other sections of this description and are not necessary for the understanding of the typical operating cycle.

The present invention has been described with reference to certain preferred embodiments. The spirit and scope of the appended claims, however, should not be limited to the foregoing description.

What is claimed is:

1. An apparatus for forming and applying flap-type gassing valves to closure ends of pressurized dispensers, each valve being formed from tape stock advanced along a tape path of the apparatus and having a backing of resilient material, a vent slot, and a layer of adhesive coextensive with the backing, the apparatus comprising:

a. means for forming successive vent slots in the tape stock, the vent slot forming means including a head, means for reciprocating the head towards and away from the tape path, and a punch carried by the head to form the vent slot when the head moves towards the tape path;

b. means for advancing the tape stock along the tape path during a first interval of a cycle and in steps so that in the cycle tape stock alternately advances along the path during the first interval and is at rest on the path during a second interval of the cycle, the tape stock advancing means including a reciprocating stepping dog engageable successively with each of the vent slots during the first interval of the cycle to advance the tape stock along the path one valve length, and means to reciprocate the stepping dog along the path over a distance greater than the one valve length advance;

c. means for holding the tape stock at rest on the path during the second interval, the holding means including a stop index dog engageable successively with each of the vent slots on the path between the vent slot forming means and the tape stock advancing means, the stop index dog holding the tape stock at rest after the stepping dog advances the tape stock one valve length and during the time the stepping dog continues along the path in the advancing direction during its reciprocation;

d. lost motion means in the tape stock advancing means operable when the stop index dog engages a vent slot in the tape to stop stepping dog advance while the tape stock advancing means tends to advance the stepping dog;

e. means for cutting the tape stock to valve length to form individual valves at a position along the path after vent slot formation, holding of the tape by the stop index dog, and tape advance by the stepping dog, the cutting means including a shear blade carried by the head, the shear blade and the punch acting on the tape while the tape is at rest during the second interval;

f. receiver means for receiving the individual valves and advancing each in turn to an activation station and a transfer station;

g. means at the activation station for activating solvent on each valve in a preselected area thereof on one side of the venting slot; and h. means at the transfer station for bonding the valve to an end closure at the preselected area.

2. The apparatus claimed in claim 1 wherein the bonding means includes a proximator to force an end closure against the activated preselected area of the valve, the receiver means acting in reaction to such force to effect bonding of the valve to the end closure.

3. The apparatus claimed in claim 2 including vacuum means to hold a valve on the receiver means, the vacuum means being operable only after the receipt of the tape stock on the receiver means but before cutting.

4. The apparatus claimed in claim 1 wherein the tape stock advancing means includes means for pivotally mounting the stepping dog to a lever, and means acting between the lever and the stepping dog to bias the dog in a direction perpendicular to the plane of the tape, the advancing means being operable to reciprocate the lever and thereby the stepping dog.

5. An apparatus for forming and applying a flap valve to an end closure of a pressurized dispenser, the flap valve serving in a pressurized dispenser to permit the gassing of the dispenser with a propellant through a gassing hole in the end closure and the prevention of propellant escape thereafter, the flap valve being generally thin and flat, having a backing layer of relatively resilient material and an adhesive layer coextensive with the backing layer, the flap valve also having a vent slot through both layers to prevent spreading of a solvent activator for the adhesive, the apparatus comprising:

a. means for advancing a length of tape stock along a tape path in the apparatus;
b. means for periodically stopping the advance of the tape stock;
c. means for forming the vent slot in the tape stock while the stock is stopped;
d. means for cutting to valve length the end of the tape stock while the stock is stopped to form a valve, such cutting means acting serially downstream from the slot formation means and at a cutting zone;
e. wheel means having at least three receivers lying on a common circle, the circle having a center at an axis of rotation of the wheel, each receiver being angularly displaced from the adjacent receivers by a displacement angle, all displacement angles being equal to one another, and at least one port to each of the receivers;
f. means to rotate the wheel in steps an amount equal to the displacement angle, the wheel rotation means presenting simultaneously a motionless receiver in the cutting zone to receive the end of the tape stock from which a valve is cut, a motionless receiver at one displacement angle from the cutting zone at an activation zone, and a motionless receiver at a transfer zone one displacement angle from the activation zone, the wheel rotation means also being operable to advance each receiver in turn from the cutting zone, to the activation zone, and to the transfer zone;
g. vacuum manifold means axially adjacent the wheel means and having slot means communicable with the ports in the wheel means over substantially two of the displacement angles, and means to provide a vacuum to the slot means to provide a vacuum through the ports at the receivers and to hold valves on the receivers;
h. means to oscillate the manifold with respect to the wheel to initiate vacuum at the cutting zone after receipt of the tape stock but prior to the cutting of the tape while terminating vacuum at the transfer zone to thereby hold the end of the tape on the receiver at the cutting zone after the end of the tape has advanced onto the receiver, to continue to hold the tape thereafter during the cutting of the end of the tape stock into a valve, to hold this valve during its rotation into the activation zone, and to hold this valve during its subsequent rotation into the transfer zone where the termination of vacuum at the transfer zone releases the valve from the wheel;
i. means to activate adhesive on the valve at the activation zone in a preselected area of the valve on one side of the vent slot; and
j. means to transfer the valve to an end closure at the transfer zone after release of the valve there through the oscillating means, such transfer including bonding the valve in the area thereof where the adhesive is activated to an inside surface of the end closure proximate the gassing hole.

6. The apparatus claimed in claim 5 including means in the manifold to provide air under pressure of the receivers at the transfer zone to assure transfer of the valves to the end closure, the air providing means including the oscillating means, the oscillating means during the oscillation communicating the port of the receiver at the transfer station with a source of air under pressure.

7. The apparatus claimed in claim 5 wherein means in the manifold is provided to apply an air blast to each receiver at the transfer zone to fully release a valve from the receiver in response to oscillation of the manifold by the oscillation means.

8. The apparatus claimed in claim 7 wherein the vacuum manifold slot means includes:

first and second arcuate slot in the manifold of different radii and overlapping at their adjacent ends; and there are first and second of the ports to each receiver communicable with the first and second slots of the manifold, respectively.

9. The apparatus claimed in claim 7 wherein:

a. the tape stock advancing means includes:
   i. a stepping dog adjacent the tape path and engageable with individual of the vent slots in the tape;
   ii. drive means to reciprocate the stepping dog in a tape advancing direction and a return direction, the displacement of the stepping dog in the advance direction being at least one valve length; and
   iii. means to engage the stepping dog with the tape during advancement of the stepping dog; and
b. the means for periodically stopping the advance of the tape stock includes:
   i. an index dog adjacent the tape path and engageable with individual of the vent slots in the tape;
   ii. means to engage the index dog with a vent slot in the tape during formation of another vent slot, the cutting of the tape, and after each advance of the tape by the stepping dog; and
   iii. means to disengage the index dog from the vent slot during the advance of the tape by the stepping dog.

10. The apparatus claimed in claim 9 including lost motion means for the reciprocating stepping dog drive means to stop advance of the stepping dog when the index dog engages a vent slot.

11. The apparatus claimed in claim 10 wherein the lost motion means includes means to stop reciprocation of the stepping dog in response to preselected stimuli at a predetermined position of the stepping dog in its cycle and permit reciprocation of the stepping dog thereafter beginning only at a preselected point in the cycle of the apparatus.

12. The apparatus claimed in claim 10 wherein:

the means for forming the vent slot includes a head above the tape path and means to reciprocate the head towards and away from the tape path, and a punch on the head for engaging the tape and forming the vent slots with movement of the head towards the tape; and the means for cutting the end of the tape stock includes a shear blade carried by the head to shear the end of the tape to valve length and form a valve thereby during movement of the head toward the tape path.

* * * * *

UNITED STATES PATENT AND TRADEMARK OFFICE

CERTIFICATE OF CORRECTION

PATENT NO. : 4,052,249

DATED : October 4, 1977

INVENTOR(S) : Roger K. Bruce and Werner Marhold

It is certified that error appears in the above-identified patent and that said Letters Patent are hereby corrected as shown below:

In the specification: Column 3, line 58, "veiw" should be --view--; Column 14, line 56, "contans" should be --contains--.

In the claims: Claim 6, column 22, line 4, "of" should be --to--; Claim 8, column 22, line 18, "slot" should be --slots--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*